US006799843B2

(12) United States Patent
Okamoto

(10) Patent No.: US 6,799,843 B2
(45) Date of Patent: Oct. 5, 2004

(54) METHOD OF MANUFACTURING STRUCTURAL BODY, LIQUID TANK AND INK JET PRINTING APPARATUS, AND AN INK JET PRINTING APPARATUS

(75) Inventor: Hideaki Okamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 12 days.

(21) Appl. No.: 10/303,834

(22) Filed: Nov. 26, 2002

(65) Prior Publication Data

US 2003/0122906 A1 Jul. 3, 2003

(30) Foreign Application Priority Data

Dec. 28, 2001 (JP) ..... 2001-401669

(51) Int. Cl.[7] ..... B41J 2/175
(52) U.S. Cl. ..... 347/86
(58) Field of Search ..... 347/85, 86, 87; 55/385.1

(56) References Cited

U.S. PATENT DOCUMENTS

| | | | | |
|---|---|---|---|---|
| 3,953,862 A | * | 4/1976 | Amberntsson et al. | 347/87 |
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,608,577 A | | 8/1986 | Hori | 346/140 R |
| 4,723,129 A | | 2/1988 | Endo et al. | 346/1.1 |
| 4,740,796 A | | 4/1988 | Endo et al. | 346/1.1 |
| 5,430,471 A | | 7/1995 | Nakajima et al. | 347/87 |
| 5,462,586 A | | 10/1995 | Sugiyama et al. | 96/13 |
| 6,447,084 B1 | | 9/2002 | Uetsuki et al. | 347/7 |
| 6,474,797 B2 | | 11/2002 | Kurata et al. | 347/85 |
| 6,540,321 B1 | | 4/2003 | Hirano et al. | 347/22 |
| 6,629,758 B2 | | 10/2003 | Okamoto et al. | 347/85 |
| 6,637,872 B2 | | 10/2003 | Ara et al. | 347/85 |
| 2001/0037629 A1 | * | 11/2001 | Mashiko et al. | 55/385.1 |
| 2002/0101489 A1 | | 8/2002 | Okamoto et al. | 347/85 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 5-201021 | 8/1993 |
| JP | 7-126428 | 5/1995 |
| JP | 9-103662 | 4/1997 |
| JP | 2000-288367 | 10/2002 |

* cited by examiner

*Primary Examiner*—Anh T. N. Vo
(74) *Attorney, Agent, or Firm*—Fitzpatrick, Cella, Harper & Scinto

(57) ABSTRACT

A method of manufacturing a structural body, a liquid tank and an ink jet printing apparatus, all having an opening in which a gas-liquid separation member maintains a good repellency, and also an ink jet printing apparatus are provided.

A gas-liquid separation member is fused by a thermal fusing head to a predetermined opening in the ink tank, after which the gas-liquid separation member is subjected to repellency application processing. More specifically, the repellency application processing is done as by coating or spraying a repellency application agent to the gas-liquid separation member. When the opening with this porous film is subjected to suction, only air in the tank is sucked out but ink is not drawn out because the ink cannot pass through the gas-liquid separation members. Hence, the interior of the tank can be kept at a negative pressure.

22 Claims, 19 Drawing Sheets

METHOD OF MANUFACTURING STRUCTURAL BODY, LIQUID TANK AND INK JET PRINTING APPARATUS, AND AN INK JET PRINTING APPARATUS

This application claims priority from Japanese Patent Application No. 2001-401669 filed Dec. 28, 2001, which is incorporated hereinto by reference.

BACKGROUND OF THE INVENTION

1. Field of the Invention

The present invention relates to a method of manufacturing a structural body, a liquid tank and an ink jet printing apparatus and to an ink jet printing apparatus. More specifically the present invention relates to a method of manufacturing a structural body, a liquid tank and an ink jet printing apparatus, all having a porous film (hereinafter referred to as a "gas-liquid separation members") attached to a gas-liquid separation portion, and to an ink jet printing apparatus.

Further, the present invention relates to a method of manufacturing a structural body, such as a liquid tank, that has a communication portion for communicating an interior of the tank, into which a liquid is introduced, to an exterior thereof through an gas-liquid separation member permeable only to gases. The invention also relates to a liquid tank and a head cartridge manufactured by the manufacturing method and an ink jet printing apparatus that uses the liquid tank and the head cartridge.

2. Description of the Related Art

Ink jet printing apparatus have come into rapidly expanding use in recent years thanks to their advantages of being able to perform color printing and reduce the size of apparatus relatively easily. Particularly a serial type ink jet printing apparatus, which can easily be reduced in size, is in widespread use. In the serial type, however, since the printing is done by scanning a carriage that mounts a print head, there is a limit to the weight that can be carried by the carriage in order to ensure its normal operation. Hence, an ink tank integrally formed with the print head (hereinafter referred to as a "subtank") has a limitation on its capacity. To deal with this problem, a construction has been proposed in which a large-capacity ink tank (or "main tank") is provided separately from this subtank to supply ink from the main tank to the subtank while the printing is not performed.

As the method for supplying ink from the main tank to the subtank a pit-in method is available. In this method the main tank is located at a desired position in the ink jet printing apparatus other than the carriage and supplies ink to the subtank through a predetermined ink supply port when the subtank comes to a predetermined position. The subtank is often formed with an atmosphere communication port to keep an inner pressure equal to the atmospheric pressure and with a suction port to make the inner pressure negative when the ink is supplied. These ports or openings are provided with a porous liquid-repellent film of fluororesin that only passes gases, not liquids, so that the ink in the tank does not leak out. An example that uses the porous liquid-repellent film of fluororesin for the atmosphere communication port is an invention disclosed in Japanese Patent Application Laid-open No. 5-201021 (1993). In this invention, a porous liquid-repellent film that is applied a liquid-repellency application agent in advance to enhance its repellency is attached to the atmosphere communication port and, heat is applied from inside the tank to the porous liquid-repellent film to fuse it to the tank body.

Thermally fusing the porous liquid-repellent film to the subtank may cause the following problem. A portion of the subtank to which the film is to be fused is heated to a temperature close to a melting point of polypropylene, which is the material of the subtank. The heat applied, however, gets applied not only to the portion where the film is to be fused but also to other portions, changing the surface of the porous film, which in turn degrades the liquid repellency of the porous film.

The deteriorated liquid repellency of the porous film results in water in the container easily permeating to the outside through the atmosphere communication port. If the liquid is ink, the degradation of the liquid repellency of the porous film increases the viscosity of the ink, changing its physical property.

Considering the above-mentioned problems experienced with the conventional apparatus, it is an object of the present invention to provide a method of manufacturing a structural body, which has an opening attached with a porous film kept in a good liquid-repellent condition, a liquid tank and an ink jet printing apparatus and also to provide an ink jet printing apparatus.

It is also an object of the present invention to provide a method of manufacturing with ease and at low cost a structural body which has a communication portion for communicating an interior of the structural body, into which a liquid is introduced, to an exterior through a gas-liquid separation member that passes only gasses, and which can keep the liquid-repellent performance of the gas-liquid separation member in good condition.

SUMMARY OF THE INVENTION

One aspect of the present invention provides a method of manufacturing a structural body, wherein the structural body has a communication portion for communicating an interior of the structural body to an exterior thereof and a gas-liquid separation member permeable only to gases and arranged on the communication portion, the method comprising the steps of: mounting the gas-liquid separation member to the communication portion; and after the mounting step, applying repellency to the gas-liquid separation member with a repellency application agent.

Another aspect of the present invention provides a method of manufacturing a liquid tank, wherein the liquid tank has a negative pressure introducing portion for introducing a negative pressure into the liquid tank, a liquid intake portion for drawing a liquid into the liquid tank by the negative pressure introduced by the negative pressure introducing portion, and a gas-liquid separation member permeable only to gases and arranged on the negative pressure introducing portion, the method comprising the steps of: mounting the gas-liquid separation member to the negative pressure introducing portion; and after the mounting step, applying repellency to the gas-liquid separation member with a repellency application agent.

Still another aspect of the present invention provides a method of manufacturing a liquid tank, wherein the liquid tank has a container body for accommodating a liquid, an opening for drawing out the liquid, an atmosphere communication port for communicating the container body to the atmosphere, and a gas-liquid separation member permeable only to gases and arranged on the atmosphere communication port, the method comprising the steps of: mounting the gas-liquid separation member to the atmosphere communication port; and after the mounting step, applying repellency to the gas-liquid separation member with a repellency application agent.

A further aspect of the present invention provides a method of manufacturing an ink jet printing apparatus, wherein the ink jet printing apparatus has a liquid tank, the liquid tank having a negative pressure introducing portion for introducing a negative pressure into the liquid tank and a liquid intake portion for drawing a liquid into the liquid tank by the negative pressure introduced by the negative pressure introducing portion; a negative pressure generation mechanism for applying a negative pressure to the liquid tank to introduce the liquid into the liquid tank; and a gas-liquid separation member permeable only to gases and arranged in a vicinity of a joint portion of the negative pressure generation mechanism with the negative pressure introducing portion; the method comprising the steps of: mounting the gas-liquid separation member to the negative pressure introducing portion; and after the mounting step, applying repellency to the gas-liquid separation member with a repellency application agent.

A further aspect of the present invention provides an ink jet printing apparatus which has a negative pressure generation mechanism for applying a negative pressure to the liquid tank manufactured by the method described above to introduce a liquid.

With the construction described above, since the gas-liquid separation member is subjected to the repellency application processing after it has been mounted to the communication portion, no additional heat is applied to the gas-liquid separation member after the repellency application processing. Therefore, the gas-liquid separation member does not change in property, thus maintaining high repellency.

Since the liquid tank manufactured by the liquid tank manufacturing method described above can maintain high repellency at all times, the gas-liquid separation can be performed reliably.

Therefore, in the ink jet printing apparatus incorporating such a liquid tank, ink can be supplied from the main tank to the liquid tank with no ink leakage.

A further aspect of the present invention provides a method of manufacturing a structural body, wherein the structural body has a communication portion for communicating an interior of the structural body, into which a liquid is introduced, to an exterior thereof through a gas-liquid separation member permeable only to gases, the method comprising the steps of: coating the gas-liquid separation member with a repellency application agent; and after the coating step, heating the gas-liquid separation member and integrally joining at least an outer peripheral portion of the gas-liquid separation member to the communication portion.

Further, the liquid tank of the invention may include a negative pressure introducing portion for introducing a negative pressure into the liquid tank, a liquid intake portion for drawing a liquid into the liquid tank by the negative pressure introduced by the negative pressure introducing portion, a gas-liquid separation member permeable only to gases and arranged on the negative pressure introducing portion, and a repellency application agent coated on the gas-liquid separation member, wherein the gas-liquid separation member is heated to evaporate solvent contained in the repellency application agent and this heating is utilized to integrally join an outer periphery of the gas-liquid separation member to the negative pressure introducing portion.

Furthermore, the liquid tank of the invention may include a casing for accommodating a liquid, an opening for drawing out the liquid from the casing, an atmosphere communication portion for communicating an interior of the casing to the atmosphere, a gas-liquid separation member permeable only to gases and arranged on the atmosphere communication portion, and a repellency application agent coated on the gas-liquid separation member, wherein the gas-liquid separation member is heated to evaporate solvent contained in the repellency application agent and this heating is utilized to integrally join an outer periphery of the gas-liquid separation member to the negative pressure introducing portion.

A further aspect of the invention provides a head cartridge comprising the liquid tank of the above construction and a liquid ejection head to which a liquid is supplied from the liquid tank and which has nozzles for ejecting the liquid.

A further aspect of the invention provides an ink jet printing apparatus comprising a mounting portion and a negative pressure generation means, the mounting portion having the liquid tank of the above construction and a liquid ejection head to which a liquid is supplied from the liquid tank and which has nozzles for ejecting the liquid, the negative pressure generation means being adapted to apply a negative pressure to the liquid tank to introduce the liquid into the tank.

A further aspect of the invention provides an ink jet printing apparatus comprising a mounting portion capable of mounting the head cartridge of this invention, and a negative pressure generation means for applying a negative pressure to the liquid tank of the head cartridge to introduce a liquid into the tank.

The above and other objects, effects, features and advantages of the present invention will become more apparent from the following description of embodiments thereof taken in conjunction with the accompanying drawings.

DETAILED DESCRIPTION OF PREFERRED EMBODIMENTS (Embodiment 1)

An embodiment of the present invention will be described by referring to the accompanying drawings.

Figure 1:
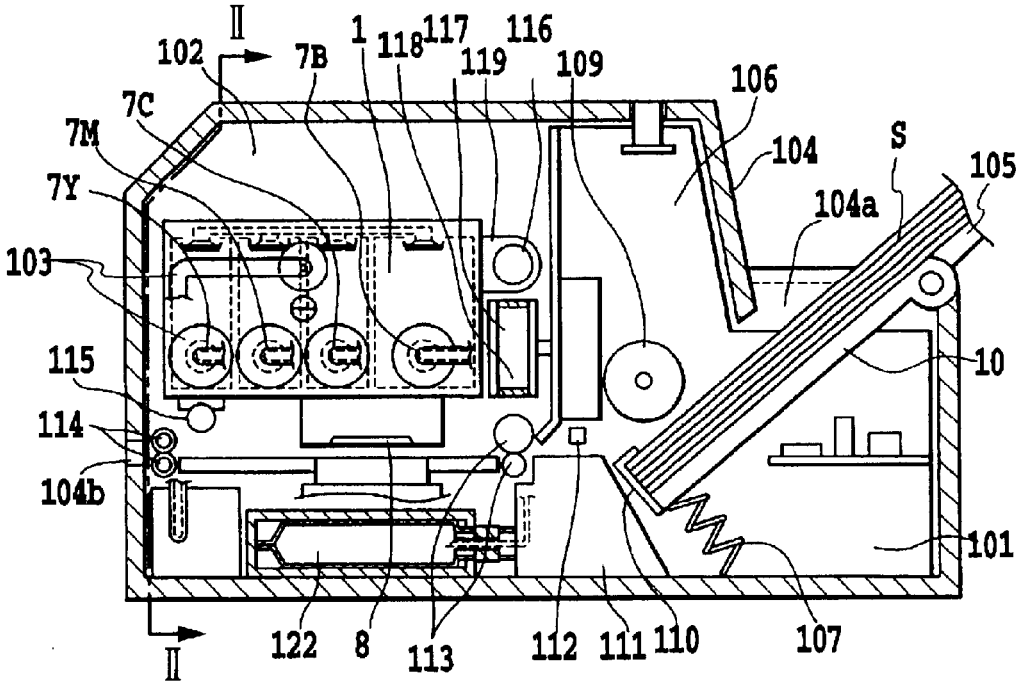
FIG. 1 is a cross-sectional view showing an ink jet printing apparatus as one embodiment of the present invention.
Figure 2:
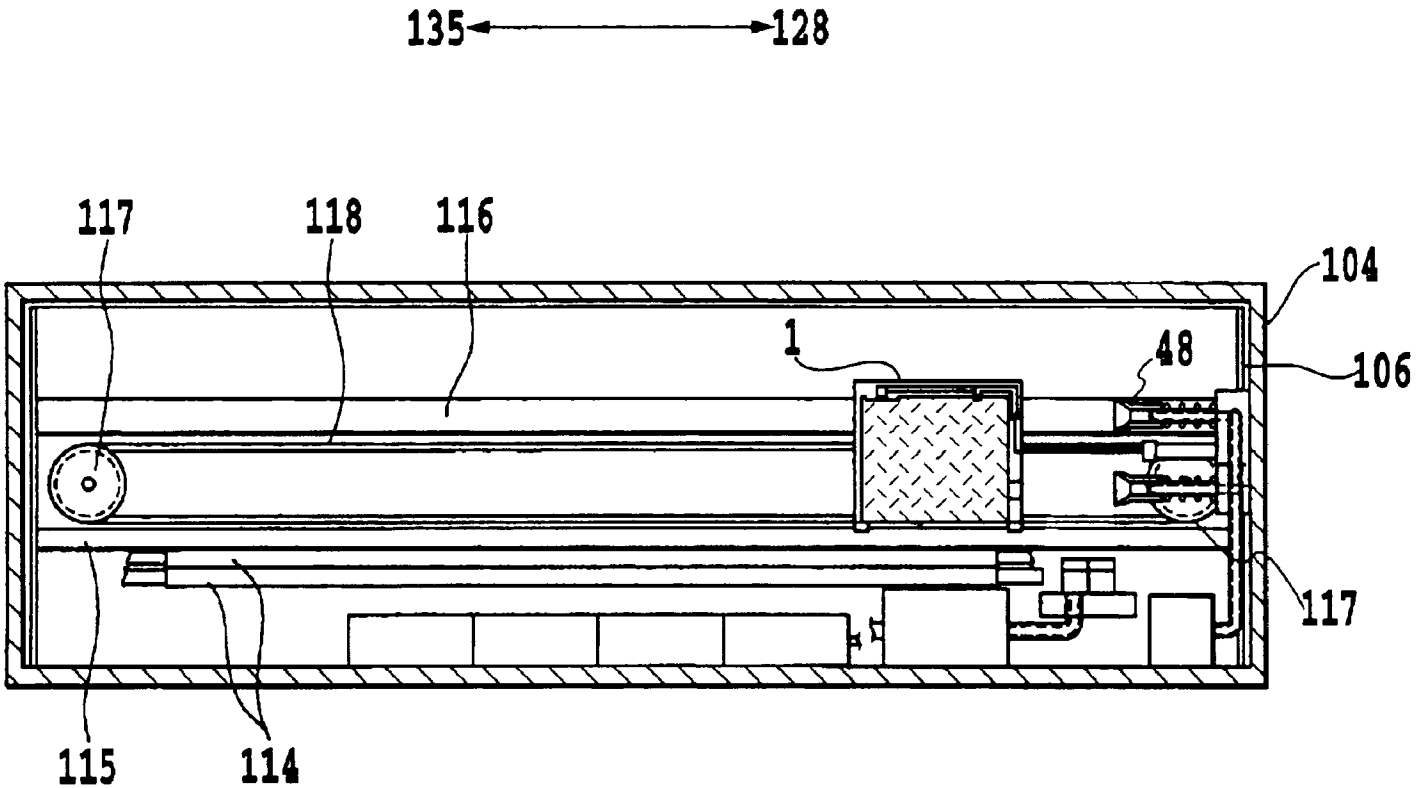
FIG. 2 is a cross-sectional view taken along the line II—II of FIG. 1.

FIG. 1 and FIG. 2 are cross sections showing an outline construction of an ink jet printer according to one embodiment of the invention. The ink jet printer of this embodiment employs a serial scan system in which a liquid ejection head moves in a main scan direction. In FIG. 1, the printer body comprises a medium supply unit 101 to supply a print medium S, a printing unit 102 to perform a printing operation, and an ink supply unit 103 to supply ink as the liquid of this invention.

Denoted 104 is a cover mounted on the outside of the printer body. A plurality of print mediums S are placed on a tray 105. The print mediums S are inserted into an insertion opening 104*a* and discharged from a discharge opening 104*b*. On the inner side of side plates 106 installed inside the cover 104 are mounted the tray 105, a supply roller 109 and a guide member 111. The tray 105 constitutes a means for supporting the print mediums S and is urged by a spring 107 toward the supply roller 109 disposed above. The supply roller 109 constitutes a means for feeding mediums and comes into contact with the uppermost one of the print mediums S put on the tray 105. The guide member 111 guides one print medium S separated by a separation means 110 toward a printing unit 102.

Designated 112 is a photosensor to detect the print medium S as it passes through a downstream side of the guide member 111. A pair of feed rollers 113 feed the print medium S at a constant speed. A pair of discharge rollers 114 discharge the print medium S printed with an image. A carriage 119 is guided by guide members 115, 116 so that it can move in a main scan direction (a widthwise direction of the print medium S) indicated by arrows 128, 135 of FIG. 2. The carriage 119 is driven in the main scan direction by a driving force transmitted from a carriage motor not shown through a belt 118 wound around a pair of pulleys 117. Denoted 1 is a storage tank (also referred to as a "subtank") replaceably mounted on the carriage 119. Designated 8 is a print head that ejects ink supplied from the subtank 1 according to image information.

In this embodiment, the subtank 1 and the print head 8 together form an integrally connected head cartridge. These subtank 1 and print head 8 may be constructed separately and then separably combined together. Or they may be mounted individually to the carriage 119.

Figure 3:
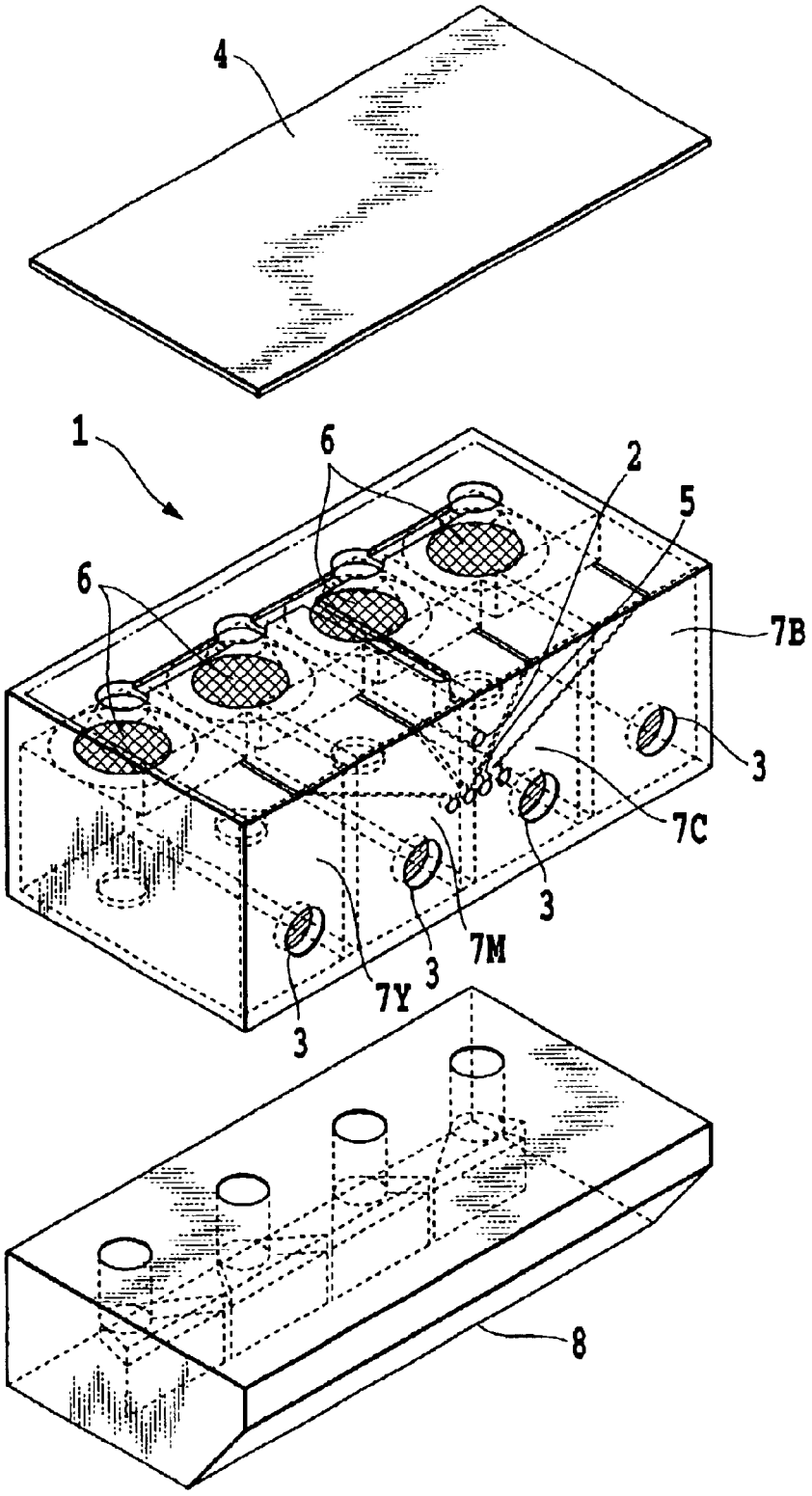
FIG. 3 is an exploded perspective view showing a subtank (ink tank) and a print head.

FIG. 3 is an exploded perspective view of the print head and the subtank.

Figure 4:
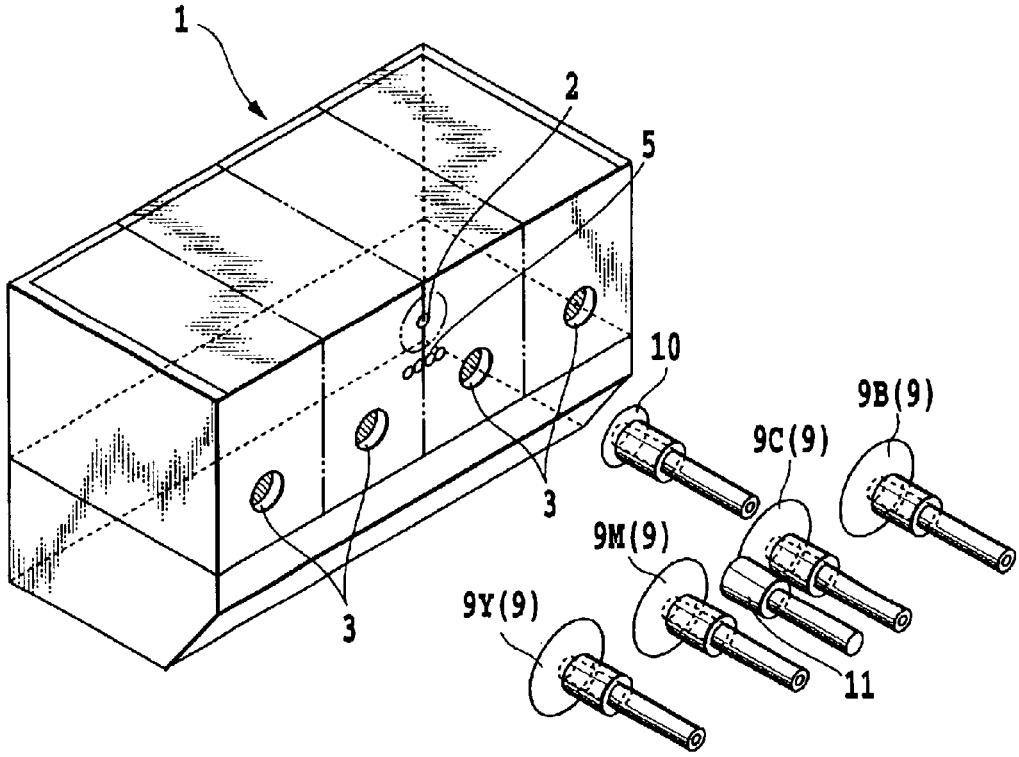
FIG. 4 is a perspective view showing the subtank (ink tank) and the print head.

FIG. 4 is a perspective view showing the subtank and the print head.

The subtank 1 storing inks has ink chambers 7, one for each ink color. These ink chambers are arranged in the order of a black ink chamber 7B, a cyan ink chamber 7C, a magenta ink chamber 7M, and a yellow ink chamber 7Y. The ink chambers are each provided with an ink supply port which communicates with an associated ink path of the print head 8 connected to the lower part of the subtank 1. The print head 8 has its interior filled with inks through the ink paths at all times. The print head 8 has an array of nozzles from which ink droplets are ejected to perform printing.

The subtank 1 has ink intake ports 3, one for each ink color, for introducing inks from the main tank. Further, for the subtank 1 to undergo a suction operation to facilitate the inflow of inks when the inks are introduced, the subtank 1 is provided with an overall suction port 2. It also has atmosphere communication ports 5 to keep the interior of the tank at the same pressure as atmosphere. To avoid mixing of different ink colors, the atmosphere communication port 5 is provided for each ink color. As can be seen from the figure, the atmosphere communication ports 5 are relatively small in diameter. The present invention, however, is not limited to this arrangement and may use large-diameter atmosphere communication ports 5 to prevent a possible degradation of air flow due to adhesion of inks. The method of supplying inks from the main tank will be detailed later.

The subtank 1 also has openings 6 that serve as gas-liquid separators, to each of which a porous film (hereinafter referred to as a "gas-liquid separation member") of fluororesin is bonded. This film has a liquid-repellency and is capable of passing air but not liquid such as ink. The openings 6 communicate with the overall suction port 2 but the porous films, because of their characteristic, prevent the inks contained in the subtank 1 from going out even when the subtank 1 is subjected to suction from the overall suction port 2. Over the porous films (openings) 6 is installed a cover 4 with an appropriate gap therebetween. The porous films are thin sheets made of polytetrafluoroethylene or similar porous resin materials.

In this embodiment, when the carriage moves to a home position on the ink jet printing apparatus body during a non-printing operation, the main tank installed at the home position communicates with the subtank on the carriage, supplying ink from the main tank to the subtank.

As shown in FIG. 4, supply joints 9, suction joint 10 and a hermetic cap 11 are provided on the home position side. When the subtank 1 reaches a predetermined home position, the ink intake ports 3 connect with the associated supply joints 9. The supply joints 9 are connected individually to the main tank not shown through tubes not shown for each ink color. Similarly, the overall suction port 2 connects to the suction joint 10 and the atmosphere communication ports 5 to the hermetic cap 11. The supply joints 9, the suction joint 10 and the hermetic cap 11 have their front ends formed of an elastic member, such as rubber, so as to hermetically close the openings on the subtank side.

The supply joints 9, the suction joint 10 and the main tank not shown, all installed at the home position, are generally called a supply unit.

Figure 5:
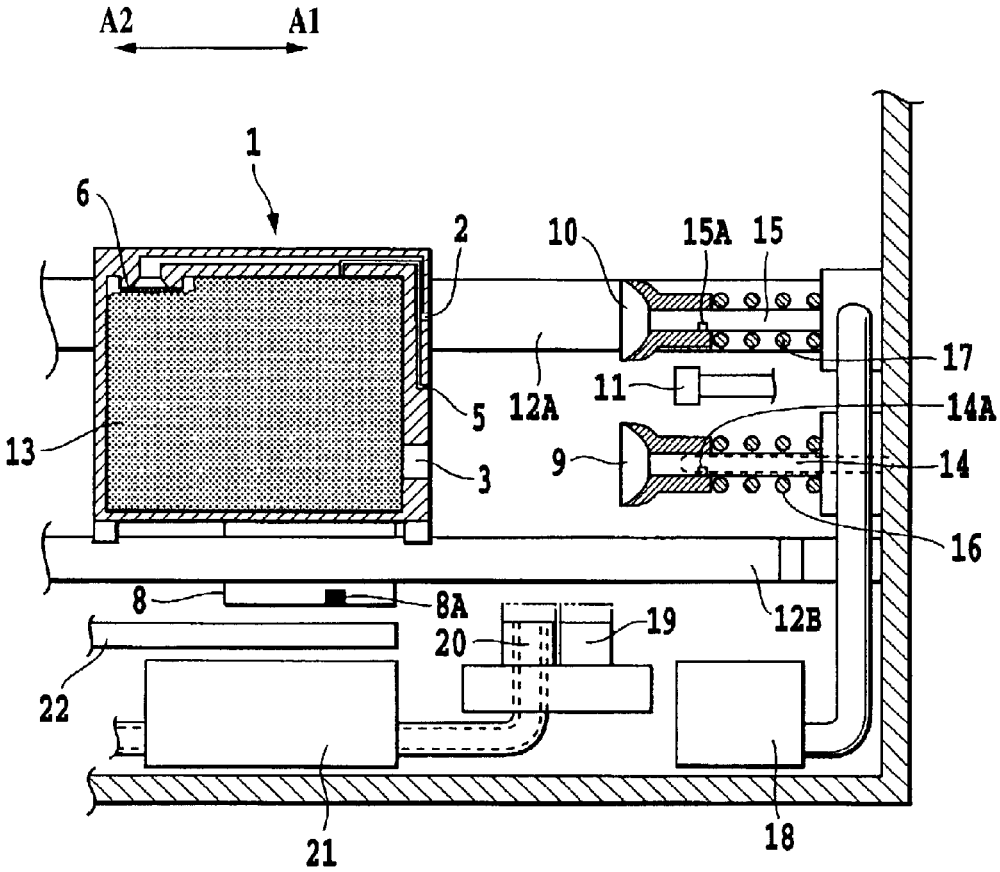
FIG. 5 is a schematic view showing a part of the ink jet printing apparatus near an ink supply unit during a printing operation.

FIG. 5 is a schematic diagram showing the print head and the supply unit during a printing operation.

The print head 8 connected to the subtank 1 sweeps over the print medium along the guide shafts 12A, 12B in a main scan direction indicated by arrows A1, A2. During this scan, the print head 8 ejects ink droplets from a plurality of its arrayed nozzles 8A onto the print medium to form an image on it. The printing operation involves first guiding the print medium by a platen 22 to a print start position and sweeping the print head 8 over the print medium from one end of the medium to the other as it ejects ink. When the print head 8 reaches the end of the print medium, the print medium is advanced a predetermined distance in a direction perpendicular to the main scan direction by a feeding means not shown. By repetitively alternating the printing by the print head and the feeding of the print medium in this way, the entire print medium is printed. It is assumed that the subtank 1 and the print head 8 are mounted on the carriage not shown.

Each nozzle is provided with a heater as an electrothermal transducer. The heater is heated to instantly produce a bubble in ink and a pressure generated by the growth of the bubble expels a predetermined volume of ink. While this embodiment uses a bubble jet system, the present invention is not limited to it and may employ other ink jet printing systems such as piezo-printing system.

The subtank 1 is formed, as described above, with the ink intake ports 3, the overall suction port 2, the atmosphere communication ports 5 and the print head 8 communication ports (not shown). The subtank 1 accommodates an ink absorber 13 for holding ink therein. On the upper surface the subtank 1 is attached with the gas-liquid separation members 6 that do not pass ink except gases.

At the home position on the ink jet printing apparatus body, hollow protruding members 14, 15 are erected parallel to the guide shafts 12. The supply joints 9 and the suction joint 10 are slidably fitted over the protruding members 14, 15 and urged toward the left in the figure by springs 16, 17 sleeved thereover. The protruding members 14, 15 are formed with through-holes 14A, 15A that are closed and opened by the supply joints 9 and the suction joint 10. The protruding members 14, 15 have their front ends closed and their base ends connected to the main tank (not shown) and a suction pump 18, respectively.

Designated 19 and 20 are first and second cap members that are provided vertically movable on the apparatus body side to cover the print head 8. The second cap member 20 is connected through a suction pump 21 to a waste liquid tank (not shown) and, during a recovery process, hermetically covers the print head to suck out viscous ink from the nozzles.

Figure 6:
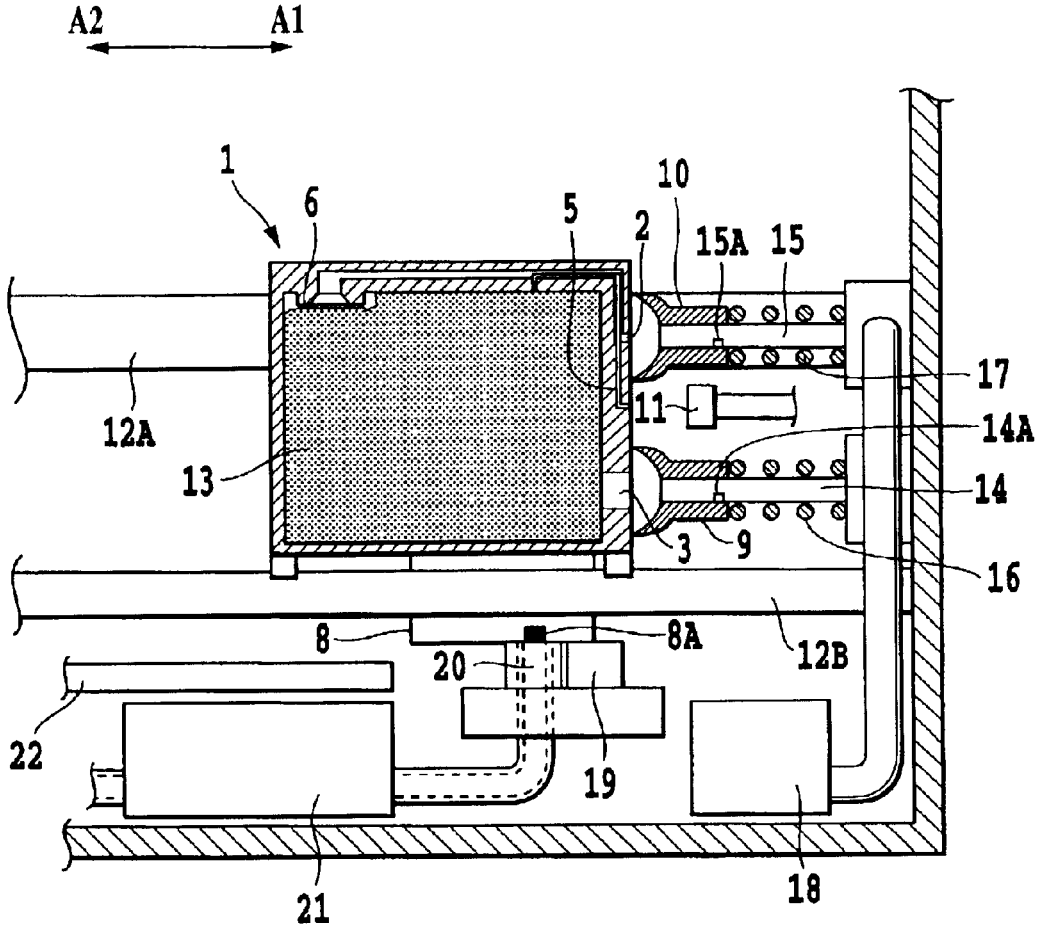
FIG. 6 is a schematic view showing a part of the ink jet printing apparatus near the ink supply unit when a printing operation is not performed.

FIG. 6 shows the print head 8 moved to the home position.

When the print head 8 and the subtank 1 mounted on the carriages reach the home position, the first and second cap members 19, 20 are raised and the second cap member 20 caps the nozzles 8A of the print head 8. At this time, the subtank 1 engages the protruding members 14, 15, with the result that the ink intake ports 3 are hermetically closed by the supply joints 9 that still close the through-holes 14A of the protruding members 14. Since the supply joints 9 are located at positions that do not close the atmosphere communication ports 5, if pressure variations occur in the subtank 1 due to ambient temperature variations, air can be introduced or exhausted between the interior and exterior of the subtank through the atmosphere communication ports 5 according to the pressure variations.

The suction joint 10 on the other hand, which still closes the through-hole 15A of the protruding member 15, closes the overall suction port 2 on the subtank 1 side.

Under this condition a recovery process is performed on the print head 8. The recovery process includes a suction process and a preliminary ejection process. The suction process involves applying a negative pressure generated by the suction pump 21 to the print head 8 through the second cap member 20 to forcibly discharge ink from the openings of the nozzles 8A by suction. The preliminary ejection process has the nozzles 8A eject ink from their openings into the second cap member 20. Performing these recovery processes can maintain the nozzles in good condition. During the non-printing state or power-off state, the print head is capped to prevent ink evaporation.

Figure 7:
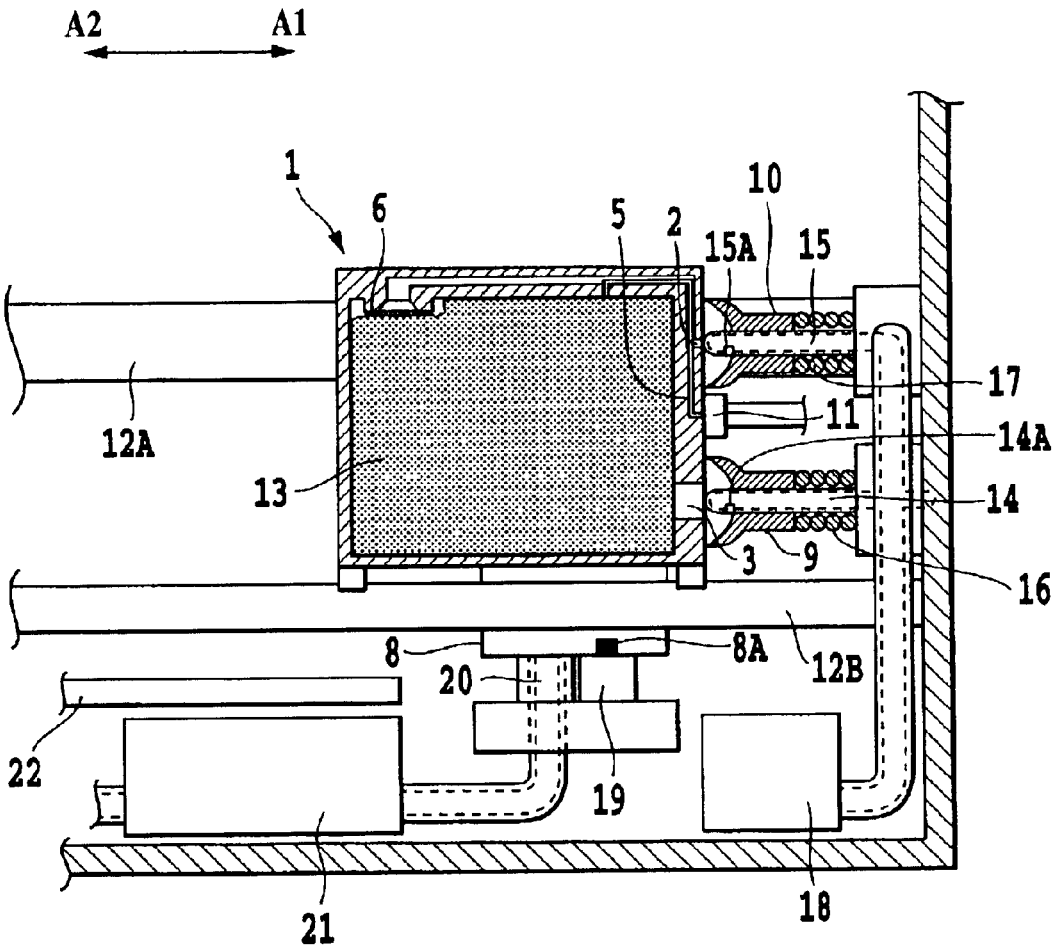
FIG. 7 is a schematic view showing a part of the ink jet printing apparatus near the ink supply unit when ink is being supplied.

FIG. 7 shows the subtank being supplied with ink.

For the ink supply operation, the print head 8 moves further from the home position in the A1 direction to an ink supply position. When the print head 8 arrives at the ink supply position, the nozzles 8A of the print head 8 are capped by the first cap member 19. At this time, the supply joints 9 still closing the ink intake ports 3 move relative to the protruding members 14 until the front ends of the protruding members 14 get into the subtank 1. In this state the through-holes 14A are opened. Because they are open to the subtank 1, the through-holes 14A form ink supply systems between the subtank 1 and the main tank. At this time, the hermetic cap 11 closes the atmosphere communication ports 5.

At the same time the suction joint 10 moves relative to the protruding member 15 until the front end of the protruding member 15 gets into the subtank. In this state the through-hole 15A is opened. Since the overall suction port 2 and the gas-liquid separation members 6 communicate with each other, the through-hole 15A also communicates with the gas-liquid separation members 6.

In this state, the suction pump 18 is operated to draw air from the subtank 1 through the gas-liquid separation members 6 and the through-hole 15A. The air thus drawn out is exhausted into a waste liquid container (not shown). The pressure in the subtank 1 now becomes negative, drawing the ink from the main tank into the subtank 1 by suction. The ink that has flowed into the subtank 1 is soaked by the ink absorber 13 raising the ink level. The speed at which the ink level increases depends on a suction force of the suction pump 18, and is set at an appropriate speed by controlling the operation of the pump. When the ink level reaches the gas-liquid separation members 6, the ink supply operation is automatically stopped because the gas-liquid separation members 6 do not pass liquids such as ink.

When the ink supply to the subtank is completed, the carriage returns to the home position. During the non-printing state, the carriage stops at the home position and, during the printing state, moves to a predetermined print start position.

The gas-liquid separation members attached to the subtank have a drawback that the liquid repellency of their surface is degraded by the heat used for their bonding. To solve this problem, this embodiment attaches the gas-liquid separation members in the following method.

Figure 8:
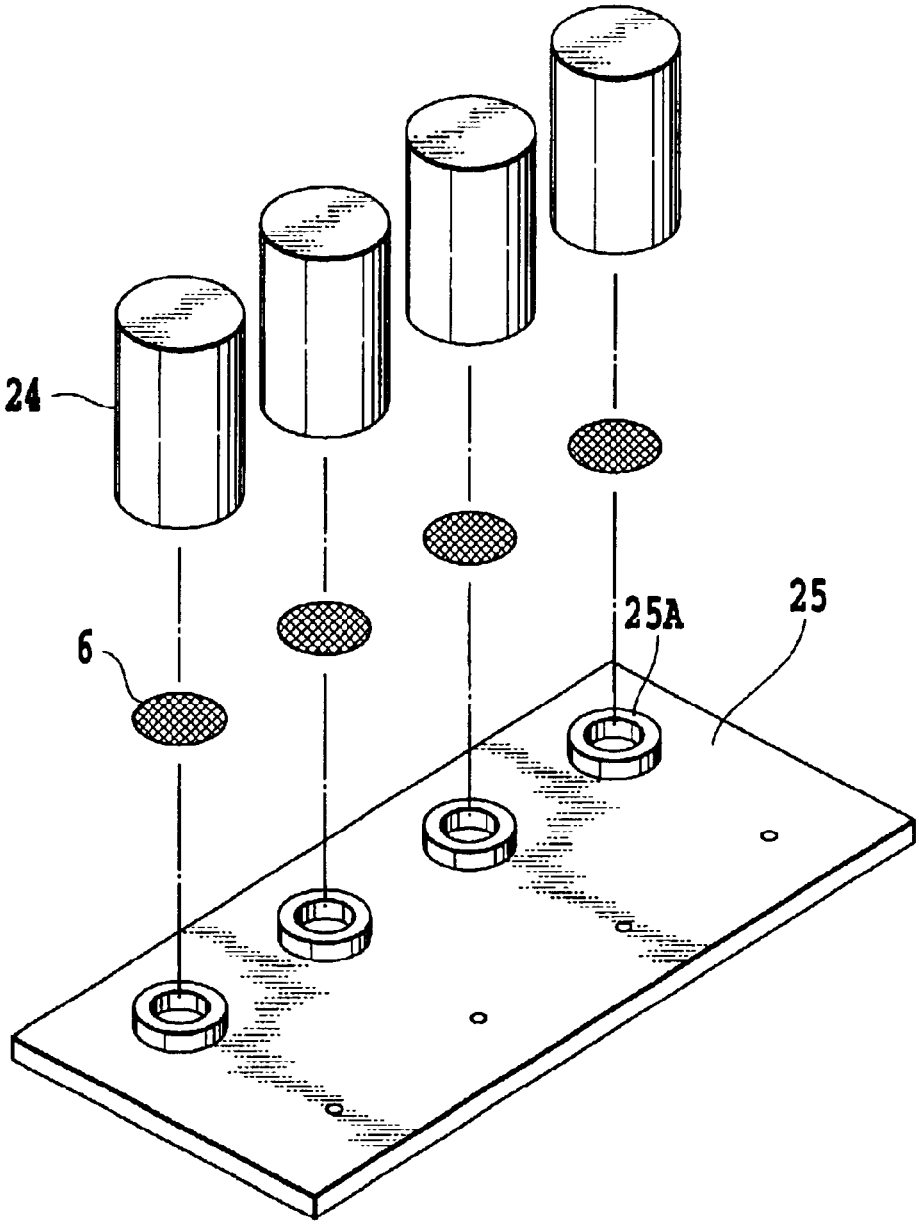
FIG. 8 is an exploded perspective view when a gas-liquid separation member is being attached to the subtank.

FIG. 8 is an exploded perspective view when the gas-liquid separation members are attached to the subtank.

Designated 24 are front ends of thermal fusing heads used to heat joints to secure the gas-liquid separation members 6 to the subtank. The fusing heads are moved vertically by a holding means not shown. Denoted 25 is a top plate of the subtank. The top plate 25 of the subtank is formed with holes at predetermined positions for gas-liquid separation. These holes are each provided with a raised portion 25A along the outer circumference thereof for fusing with the gas-liquid separation members 6. On its back side, the top plate 25 is formed integral with the cover member 4 shown in FIG. 3.

The gas-liquid separation members 6 themselves do not have a liquid repellency when attached to the subtank 1, and thus are given a liquid repellency application treatment after they are fused to the subtank 1.

Figure 9A:
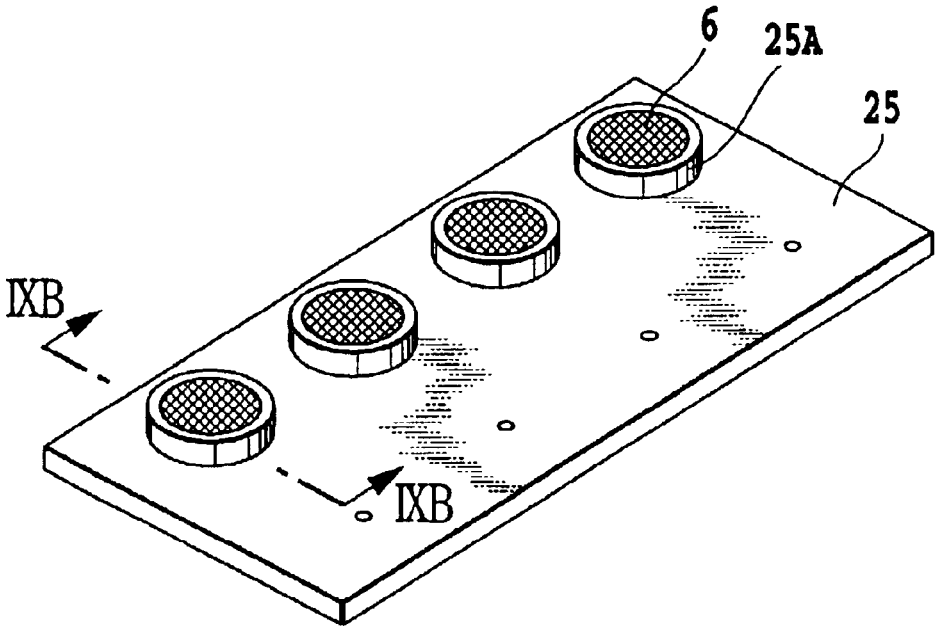
FIG. 9A is a perspective view showing the subtank attached with a gas-liquid separation member.
Figure 9B:
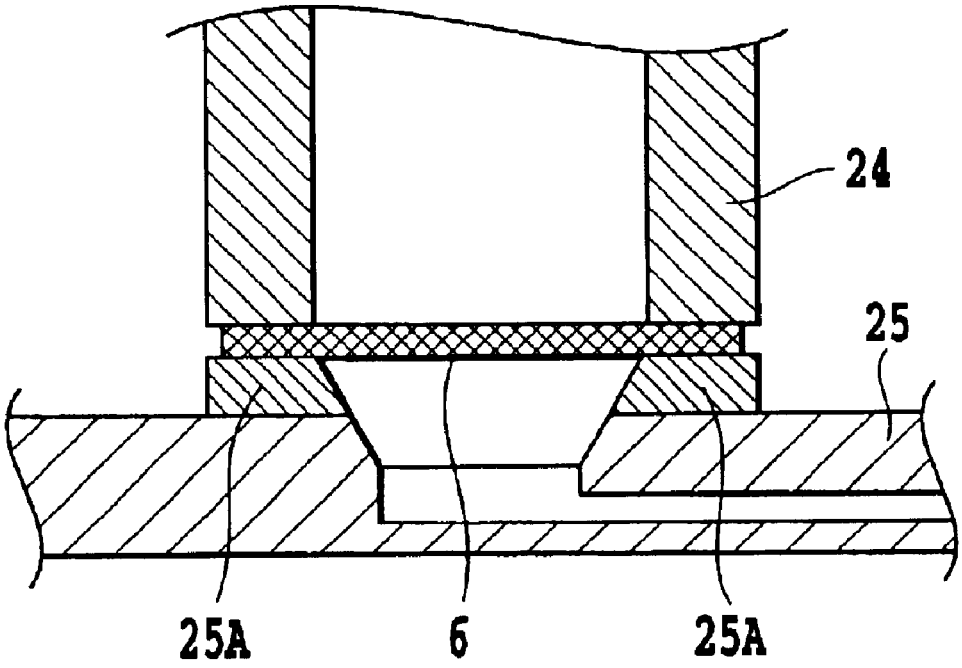
FIG. 9B is an IXB—IXB cross-sectional view of FIG. 9A.

FIG. 9A is a perspective view showing the subtank attached with the gas-liquid separation members. The upper side of the top plate 25 in the figure forms the interior of the subtank. FIG. 9B is a cross section taken along the line h—h of FIG. 9A with the thermal-fusing head 24 for securing the gas-liquid separation members also shown.

With the gas-liquid separation members 6 positioned on the raised portions 25A by a positioning means not shown, the thermal fusing heads 24 are pressed against gas-liquid separation members 6 as shown in FIG. 9B to fuse them. The thermal fusing heads 24 have a cylindrical structure with a hollow central portion which is shown not shaded. The heads 24 heat the raised portions 25A of the top plate 25 through the gas-liquid separation members 6. The top plate 25 is made from a resin molding member such as noryl and polypropylene and can be melted for bonding with the gas-liquid separation members 6 by heating to about 180° C. by the thermal fusing heads 24.

With the gas-liquid separation members secured to the subtank in this manner, the gas-liquid separation members surface are treated with a liquid-repellency application agent to improve the repellency toward ink.

The gas-liquid separation members are preferably made from fluororesins, such as PTFE (polytetrafluoroethylene), polychlorotrifluoroethylene, tetrafluoroethylene-hexafluoropropylene copolymer, tetrafluoroethylene-perfluoroalkylvinylether copolymer, and tetrafluoroethylene-ethylene copolymer. These fluororesins have excellent gas permeability and chemical resistance and thus are effective for gas-liquid separation. This embodiment uses as the gas-liquid separation members a PTFE sheet that is made porous by a uniaxial or biaxial stretching. This material is most suited in this invention.

When the PTFE porous film is used as a filter, it may be laminated with a gas-permeable substrate to secure a sufficient strength. The substrate may include nonwoven fabric, fabric and net.

As for the kind of liquid-repellency application agent and the liquid-repellency application processing, those described in Japanese Patent Application Laid-open Nos. 7-126428 (1995), 9–103662 (1997), and 2000-288367. Other processing may be used as long as they can produce a higher liquid-repellency than that of the base material (in this case PTFE).

Example liquid-repellency application agents that may be used include a variety of fluorine-containing polymers. Fluorinated polymers form a film of low surface free energy on the surface of fibers, thus exhibiting repellency. Fluorine-containing polymers preferably have a perfluoroalkyl group. The application of repellency may be done by impregnation, coating and spraying of repellency application agents. The amount of agent to be applied should preferably be adjusted to ensure that a desired repellency is obtained and the gas permeability of the filter is not inhibited.

When one wishes to perform the repellency application processing on a large quantity at one time, a large number of subtanks fabricated to the state of FIG. 9A may be mounted to a jig for bulk processing.

As described above, since this embodiment performs the repellency application processing after the gas-liquid separation members have been fixed, no heat is added to the gas-liquid separation members after the repellency application processing, thus securing a good repellency performance.

(Embodiment 2)

While in the embodiment 1 the gas-liquid separation members are secured to the subtank body by thermal fusing, it is possible to integrally form the resin, used as a mount on the subtank side, and the gas-liquid separation members. After they are integrally formed, the above-described repellency application processing may be performed.

(Embodiment 3)

In this embodiment an arrangement will be explained in which, when mounting the gas-liquid separation members to the top plate, the repellency application agent is first applied to the gas-liquid separation members and then the gas-liquid separation members are fused by a pressing jig utilizing the heat used to dry the repellency application agent. This embodiment may include an additional step of forming an adhesive layer at least where outer peripheries of the gas-liquid separation members are fused to the top plate disposed between the gas-liquid separation members and the communication portion. In this case, an adhesive that forms the adhesive layer may be a thermosetting adhesive that hardens when the gas-liquid separation members is heated, or a hot melt adhesive that melts when the gas-liquid separation members are heated. Details of the adhesive will be described later.

Figure 10:
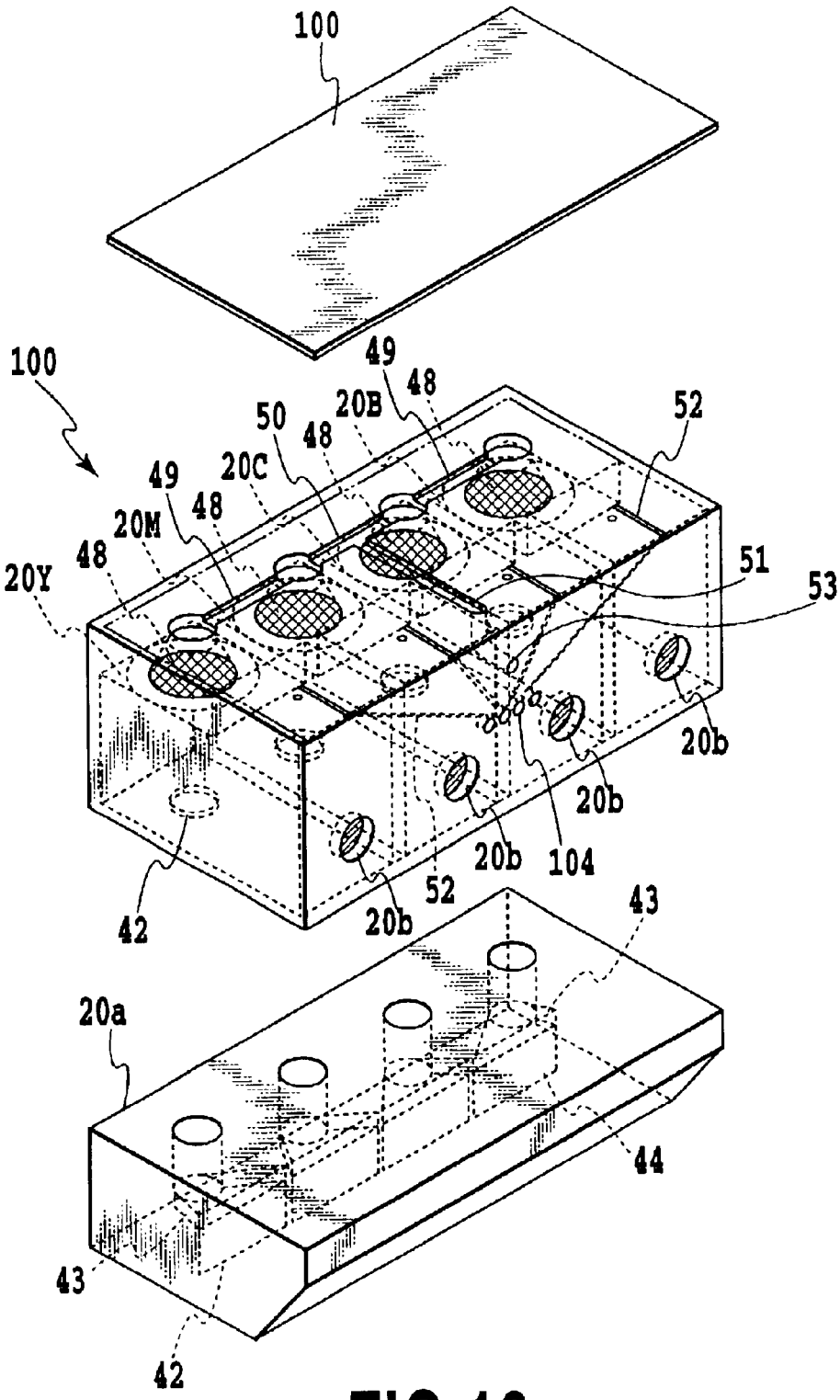
FIG. 10 is an exploded perspective view of a head cartridge in another embodiment of the present invention.

A disassembled head cartridge 30 of this embodiment is shown in FIG. 10. A print head 20*a* has a plurality of independent head portions dedicated for respective ink colors. Each of the head portions has a common ink chamber 43 communicating to an ink supply port 42 of an associated ink tank 20 and a plurality of nozzles 44 for ejecting ink droplets. An ink path portion connecting the common ink chamber 43 and the nozzles 44 is provided with an ejection energy generation portion (not shown) that generates an energy for ejecting ink from the nozzles 44.

In this embodiment, grooves in the top surface of the body of the ink tank 20 and a cover member 100 joined to the ink tank body top surface together form suction paths 49–51 and air paths 52 between the ink tank 20 and a common suction port 53 and atmosphere communication ports 104. Although the atmosphere communication ports 104 of this embodiment are relatively small in diameter, only their opening ends may be formed large, without changing the cross-sectional areas of the air paths 52 themselves, to prevent a possible clogging of the atmosphere communication ports 104 with inks adhering to around ink intake ports 20*b*. The opening ends of the suction paths 49 opening to the individual subtanks 20B, 20C, 20M, 20Y function as the communication portion of this invention and are covered with gas-liquid separation members 48 described below.

Figure 11:
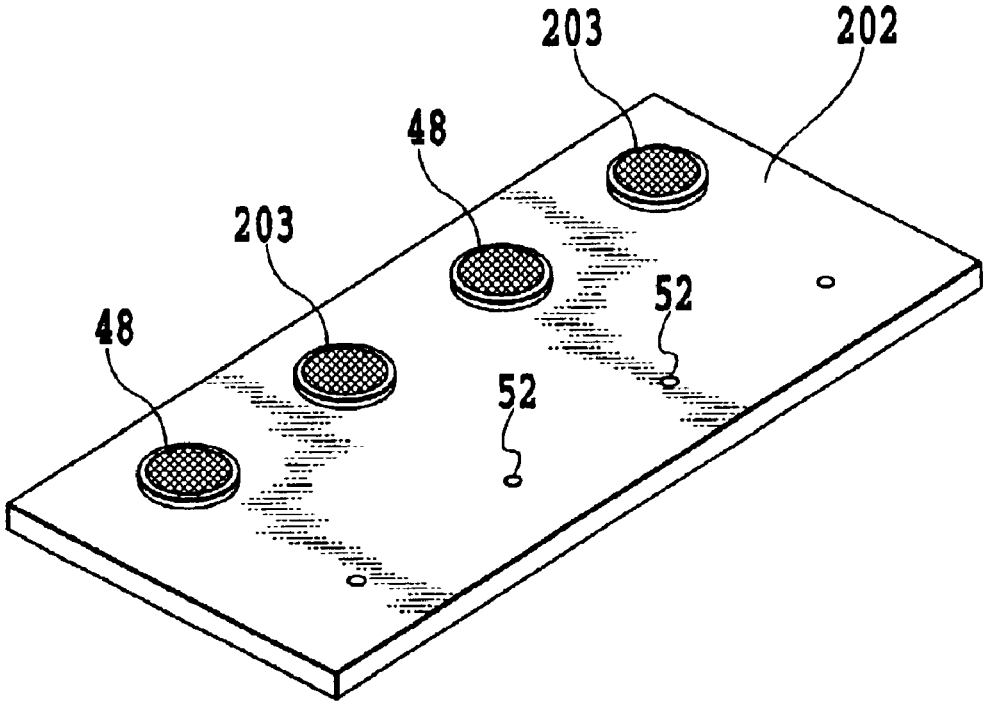
FIG. 11 is a perspective view showing an outline of an inside of a storage tank top plate.

FIG. 11 is a perspective view showing an outline of the inner side of the top plate of the ink tank. Denoted 202 is a top plate of the ink tank 20 which is formed integral with the cover member 100 shown in FIG. 10. The gas-liquid separation members 48 permeable to gas molecules have their outer peripheries integrally joined to ring-shaped seat portions 203 formed on the top plate 202 to which the suction paths 49 open, to prevent the liquid inks from leading out through the suction paths 49.

Figure 12:
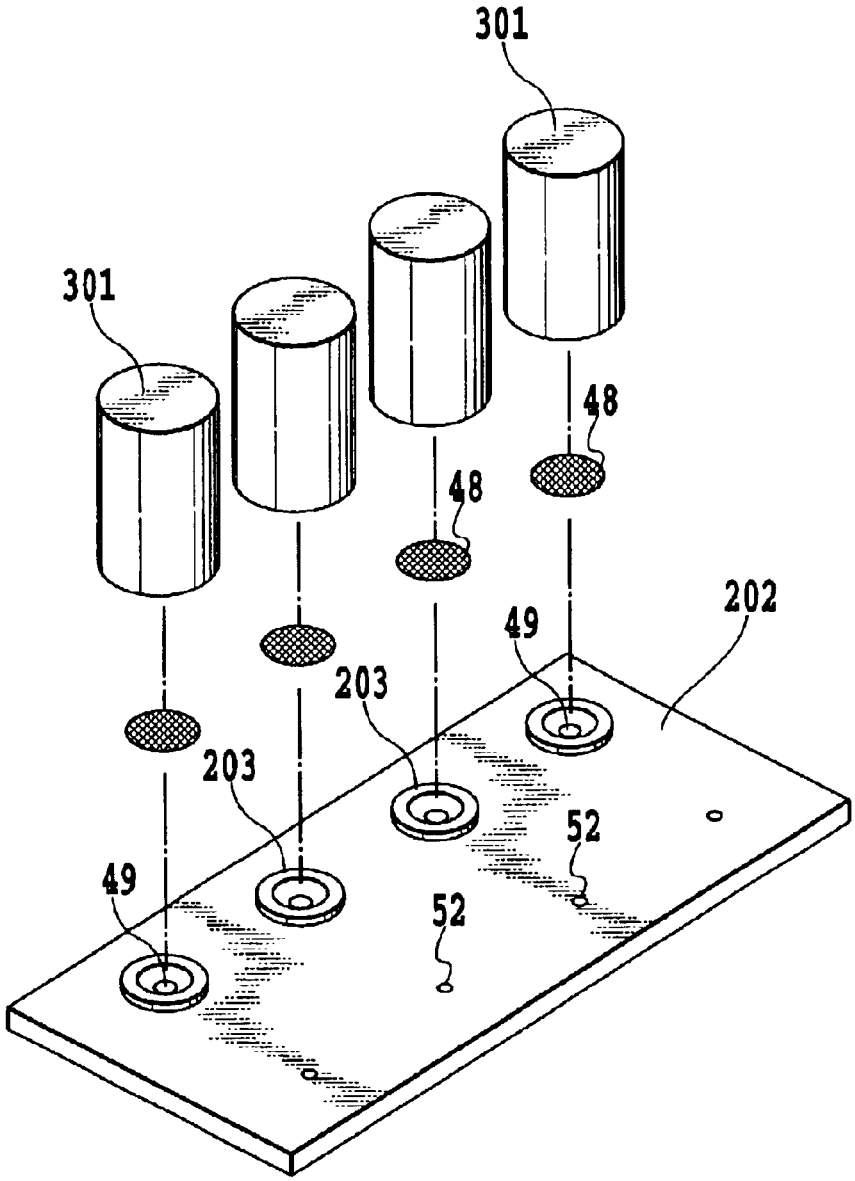
FIG. 12 is a perspective view showing a process of mounting gas-liquid separation members to the top plate.
Figure 13:
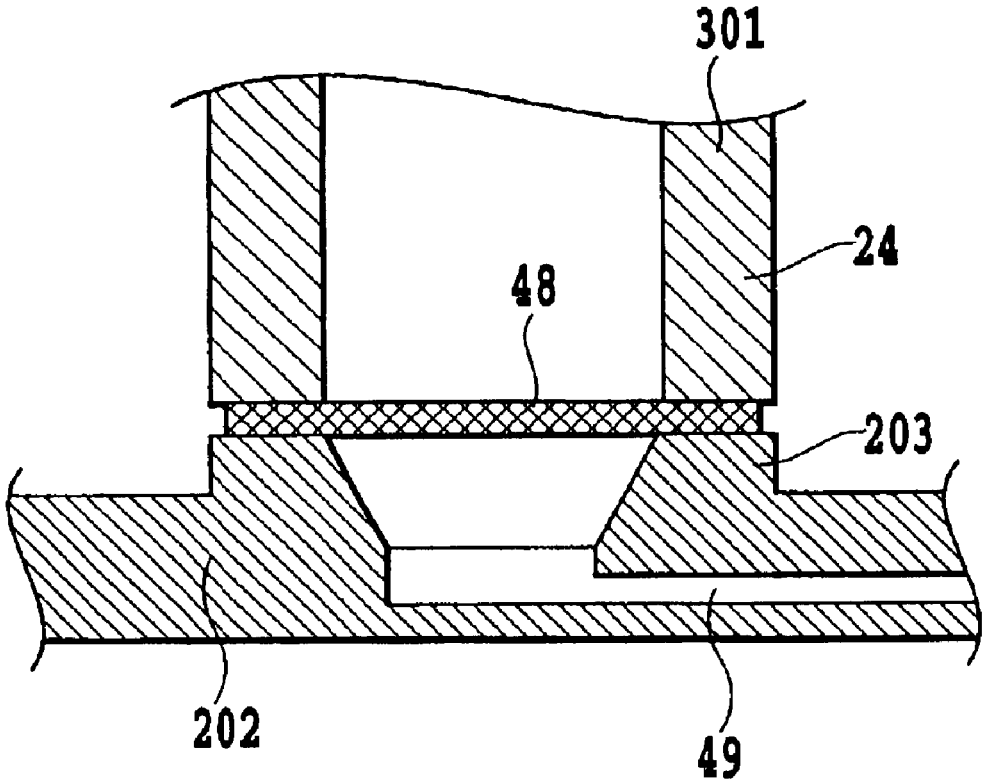
FIG. 13 is a cross-sectional view conceptually showing how the gas-liquid separation member is joined to the top plate of FIG. 11, with the gas-liquid separation member pressed against the top plate by a pressing jig.

The procedure for joining the gas-liquid separation members 48 to the top plate 202 is shown in FIG. 12 and FIG. 13. First, cup-shaped pressing jigs 301 having inner diameters almost matching diameters of opening ends of the suction paths 49 are prepared. The gas-liquid separation members 48 are concentrically positioned on the ring-shaped seat portions 203 protruding from the top plate 202, and the pressing jigs 301 are pressed against the seat portions 203 so that the lower end faces of the pressing jigs 301 engage the outer peripheries of the gas-liquid separation members 48. Under this condition, the upper ends of the seat portions 203 engaged by the outer peripheries of the gas-liquid separation members 48 are melted to integrally join the outer peripheries of the gas-liquid separation members 48 to the seat portions 203. As a result, the interior of the ink tank 20 and the suction paths 49 are separated by the gas-liquid separation members 48 so that only gases such as air and water vapor can pass through the gas-liquid separation members 48 between the interior of the ink tank 20 and the suction paths 49.

In this embodiment, just before the heating process to evaporate solvent contained in the repellent application agent described later is finished, the pressing jigs 301 are pressed against the outer peripheries of the gas-liquid separation members 48 to melt the upper ends of the seat portions 203 by utilizing the heat of the gas-liquid separation members 48 heated by the heating process. Hence, there is no need to embed electric heaters in the cylindrical front ends of the pressing jigs 301 supported vertically movable relative to the top plate 202.

The gas-liquid separation members 48 in this embodiment are porous members made from fluororesins, such as PTFE, polychlorotrifluoroethylene, tetrafluoroethylene-hexafluoropropylene copolymer, tetrafluoroethylene-perfluoroalkylvinylether copolymer, and tetrafluoroethylene-ethylene copolymer. These fluororesins have excellent gas permeability and chemical resistance and thus are preferable materials for use in ink jet printing apparatus that handle inks and processing liquids. As the porous members, a thin film material formed porous by uniaxially or biaxially stretching a PTFE sheet is particularly desirable.

If the porous members of PTFE are used as the gas-liquid separation members 48, it is advantageous to laminate it with a gas-permeable substrate to secure a sufficient strength. The substrate may include nonwoven fabric, fabric and net.

The surfaces of the gas-liquid separation members 48 are coated with a repellency application agent to improve repellency toward inks and processing liquids. As for the kind of the repellency application agent and the repellency application processing, techniques disclosed in Japanese Patent Application Laid-open Nos. 7-126428 (1995), 9–103662 (1997) and 2000-288367 may be adopted as is. Whatever the case, a repellency application agent used needs only to have a higher repellency than that of the material of the gas-liquid separation members 48.

Since polymers with chains containing fluorine atoms form a film of low surface free energy on the surface of fibers, exhibiting repellency, a variety of fluorine-containing polymers can be used as repellency application agents. A preferable fluorine-containing polymer is one having a perfluoroalkyl group. The application of repellency may be done by any desired method, such as impregnating or spraying the repellency application agent to the gas-liquid separation members 48. The amount of agent to be applied to the gas-liquid separation members 48 should preferably be adjusted to ensure that a desired repellency is obtained and the gas permeability of the filter is not inhibited.

When the gas-liquid separation members 48 are coated with a repellency application agent, it is necessary to evaporate solvent contained in the repellency application agent and fix it to the gas-liquid separation members 48. For this purpose, the heating process is described in Japanese Patent Application Laid-open No. 7-126428 (1995) to heat the gas-liquid separation members 48 at 150° C. for 10 minutes and in Japanese Patent Application Laid-Open No. 2000-288367 to heat them at about 140–180° C., preferably 150–170° C., for about 3–20 minutes.

In this invention, provisions are made so that the heating process for evaporating solvent contained in the repellency application agent also serves as a heating process for joining the gas-liquid separation members 48 to the seat portions 203 of the top plate 202. That is, when a heating process for heating at 180° C. for 20 minutes needs to be performed to evaporate solvent, the top plate 202 needs only to be selected from materials with a melting point of 180° C. or lower. In this embodiment polypropylene is used for the material of the top plate 202. Because polypropylene can be joined to the gas-liquid separation members 48 by heating it at 180° C. for only about 2 to 10 seconds, simply pressing the pressing jigs 301 against the seat portions 203 of the top plate 202 just before the end of the 20 minutes of heating process and holding them in this condition for about 2–10 seconds can transfer the heat of the gas-liquid separation members 48 to the seat portions 203 of the top plate 202, thus melting the seat portions 203 and securely joining them to the gas-liquid separation members 48.

The gas-liquid separation members 48 may also be joined to the seat portions 203 of the top plate 202 as follows. The gas-liquid separation members 48 formed, by stamping, into circular pieces with their outer diameters corresponding to those of the seat portions 203 are held by a holding member not shown, subjected to the repellent application processing and then loaded into a furnace (not shown) for heating to vaporize solvent; Just before the end of this processing, the top plate 202 is loaded into the furnace; In the furnace, the gas-liquid separation members 48 are overlapped on the seat portions 203 of the top plate 202 and the pressing jigs 301 installed inside the furnace are used to join the gas-liquid separation members 48 to the seat portions 203 of the top plate 202. Alternatively, a sheetlike gas-liquid separation member 48 of a certain size is treated with the repellent application agent and is joined to a plurality of seat portions 203 of the top plate 202, after which unwanted portions of the sheet is removed.

Since the gas-liquid separation members 48 are heated and fused to the seat portions 203 of the top plate 202 just before the end of the heating process associated with the repellency application processing, there is no need to heat the gas-liquid separation members 48 after the heating process for evaporating solvent contained in the repellency application agent is finished. Also, there is no need to use dedicated heaters for heating and fusing the gas-liquid separation members 48 to the seat portions 203 of the top plate 202.

While in the third embodiment described above, the heat applied to the gas-liquid separation members 48 is utilized when pressing the gas-liquid separation members 48 against the seat portions 203 of the top plate 202 by the pressing jigs 301 to fuse them together, it is possible to interpose a thermosetting adhesive layer between joining surfaces, i.e., between the upper end faces of the seat portions 203 and the outer peripheries of the gas-liquid separation members 48 to improve their joining performance. In this case, for better joining between the adhesive layer, the gas-liquid separation members 48 and the seat portions 203, it is preferred that the upper end faces of the seat portions 203 and the outer peripheries of the gas-liquid separation members 48 be subjected in advance to a surface treatment as by UV ozone processing and low pressure plasma asher.

Among thermosetting adhesives that can be used in this embodiment are E3210 and E1172 (both tradenames) of Emerson & Cuming composed of 1-liquid type epoxy resin and S-Dyne 3100S (tradename) of Sekisui S-Dyne composed of 2-liquid composite type epoxy resin. These adhesives may be chosen according to conditions such as temperature and duration of heating in the repellency application processing. The glueing time is preferably equal to the heating time in the repellency application processing but there is no problem as long as the glueing time is within the range of heating time. For example, when it is necessary to perform heating at 150° C. for 10 minutes, it is desired that the hardening of the adhesive be completed within 10 minutes at 150° C.

When such an adhesive layer is formed between the seat portions 203 and the gas-liquid separation members 48, materials having a higher melting point than the heating temperature can be used for the top plate 202, which in turn increases the degree of freedom of design for the material of the top plate 202.

An adhesive layer using a hot melt adhesive may be formed between the seat portions 203 and the gas-liquid separation members 48. In this case too, an appropriate hot melt adhesive can be selected according to conditions such as heating temperature and duration in the repellency application processing. The glueing time is preferably equal to the heating time in the repellency application processing but there is no problem as long as the glueing time is within the range of heating time. For example, when it is necessary to perform heating at 150° C. for 10 minutes, it is desired that the hardening of an adhesive be completed within 10 minutes at 150° C. As an example, if a hot melt adhesive which completes bonding in 10 seconds at 150° C. is used, it is only necessary to press the pressing jigs 301 against the gas-liquid separation members 48 put on the top plate 202 applied with the hot melt adhesive for 10 seconds just before the end of the heating process.

Further, for an adhesive layer a resin may be used whose melting point is lower than the heating temperature that is used for evaporating solvent contained in the repellency application agent. For example, if the heating temperature is set at 140° C., the top plate 202 of polypropylene does not melt. Thus, ABS resin formed into rings of almost the same geometry as the upper end faces of the seat portions 203 may be used as an adhesive layer. This ABS is melted and applied to the outer peripheries of the gas-liquid separation members 48 to bond them to the seat portions 203. In this case, annular grooves are formed in outer peripheral surfaces of the seat portions 203 so that the melted ABS flows into the grooves, thereby preventing a possible trouble of the ABS falling off the seat portions 203.

Although in either of the embodiment 1, 2 and 3 the porous films (gas-liquid separation members) are secured to the subtank, they may be mounted on the ink jet printing apparatus body at a position that opposes the overall suction port of the subtank during the ink supply state of FIG. 5.

This arrangement will be explained in detail by referring to FIG. 14 to FIG. 18.

Figure 14:
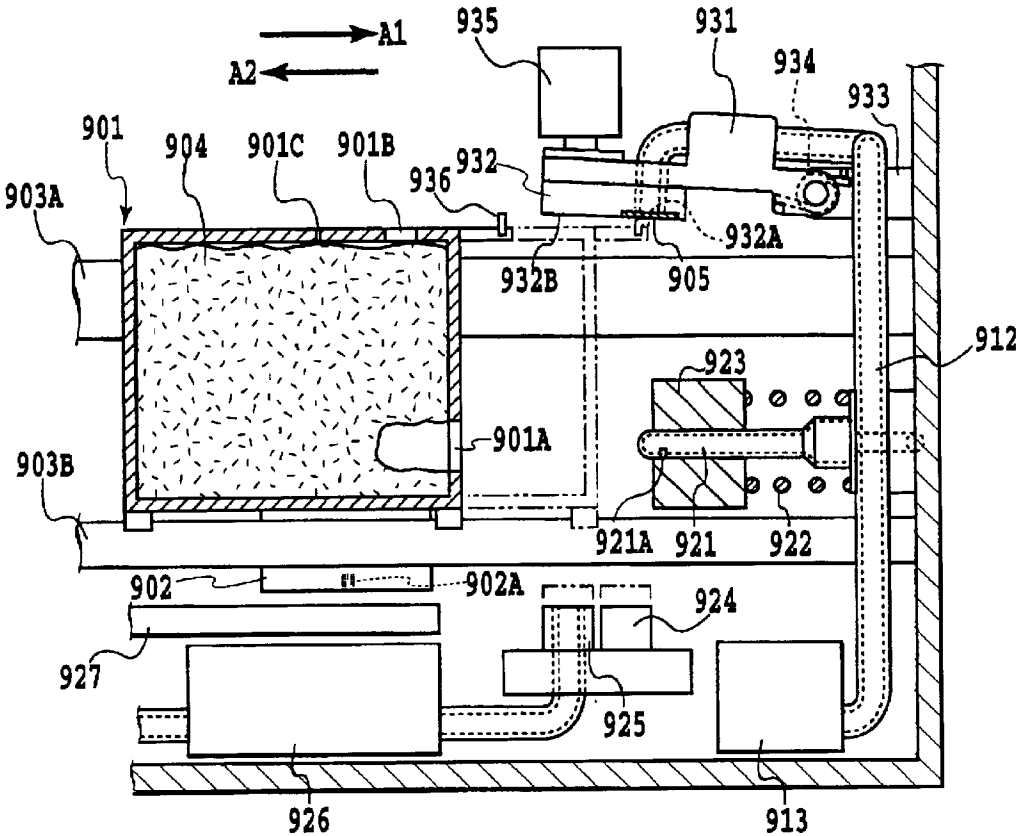
FIG. 14 is a cross-sectional view of the ink jet printing apparatus when the gas-liquid separation member is provided on the ink jet printing apparatus body side.

Referring to FIG. 14, reference number 901 denotes an ink tank for storing ink, and 902 a print head for ejecting ink stored in the ink tank 901 from a nozzle portion 902A. These are moved along guide shafts 903A, 903B in the main scan direction (indicated by arrows A1, A2). The ink tank 901 and the print head 902 can be removably mounted on a carriage (not shown) guided along the guide shafts 903A, 903B. The ink tank 901 is formed with an ink intake port 901A, a suction port 901B, an atmosphere communication port 901C, and an ink supply port (not shown) communicating with the print head 902. Accommodated in the ink tank 901 is an ink absorber 904 that absorbs and holds ink.

Figure 15:
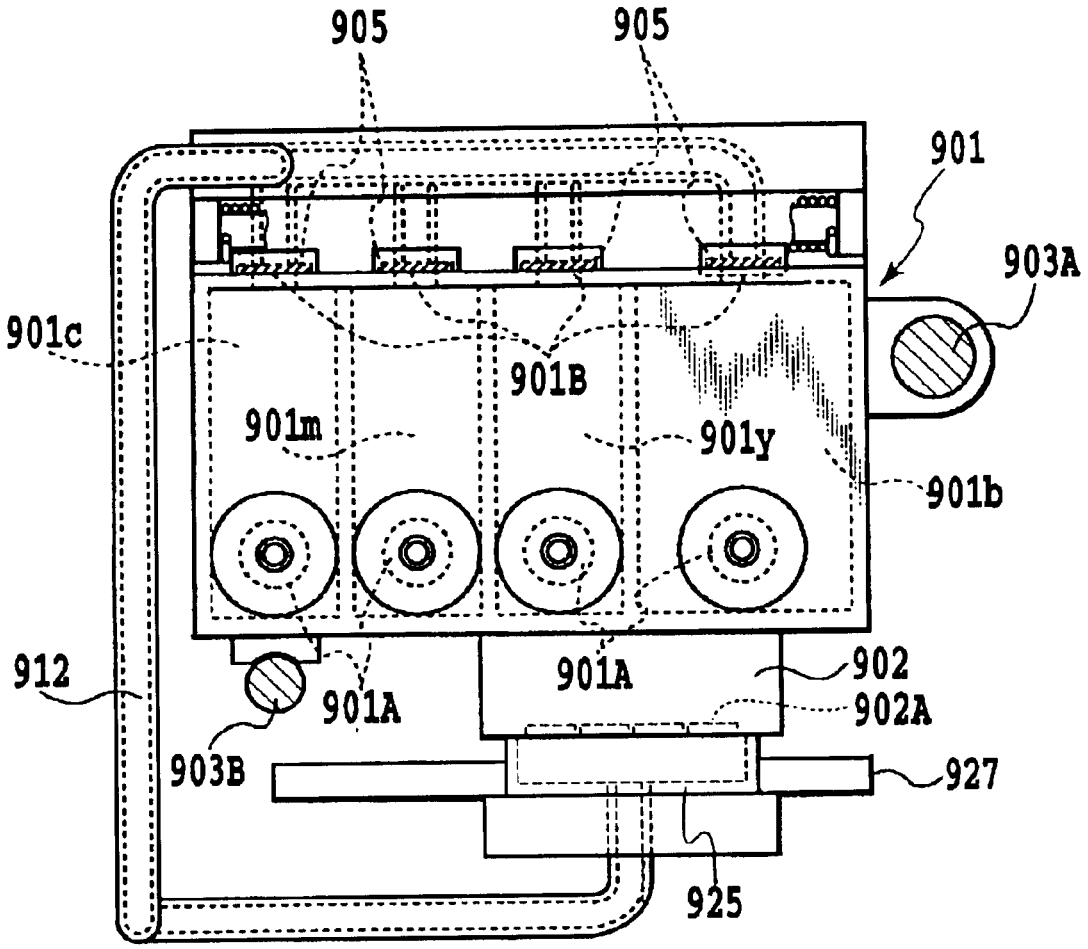
FIG. 15 is a side view of FIG. 14.

In this example, as shown in FIG. 15, the ink tank 901 has subtanks 901*c*, 901*m*, 901*y*, 901*b* for storing cyan, magenta, yellow and black inks, respectively. Each of these subtanks is formed with the ink intake port 901A, suction port 901B, atmosphere communication port 901C and ink supply port. Considering the frequent use of the black ink, the black ink subtank 9001*b* is formed larger than other subtanks. The nozzle portion 902A of the print head 902 is provided for each ink color. The ink tank 901 and the print head 902 may be combined to form an ink jet cartridge, or they may be divided for each ink color.

In FIG. 14, reference number 921 represents is a hollow protruding member erected on the apparatus body, over which a seal member 923 urged to the left by a spring 922 is slidably fitted. The hollow protruding member 921 is formed with a through-hole 921A that is opened and closed by the seal member 923. The front end of the hollow protruding member 921 is closed and its base end is connected to a supply tank not shown.

Denoted 931 is an arm member which is vertically pivotally supported by a support member 933 on the apparatus body and urged downward by a spring 934. A seal member 932 attached to the front end of the arm member 931 has an opening 932A capable of communicating to the suction port 901B and also a seal portion 932B that can close the suction port 901B and the atmosphere communication port 901C. The opening 932A is connected through a suction pipe 912 to a suction pump 913. In this example, the openings 932A for the subtanks 901*c*, 901*m*, 901*y*, 901*b* are, as shown in FIG. 15, merged into the suction pipe 912 and then connected to the common suction pump 913. Further, each opening 932A is attached with a gas-liquid separation member 905 that blocks ink but passes gases. The gas-liquid separation member 905 is made from the same material as the gas-liquid separation members 6 described in the preceding embodiment and its surface is also given the similar repellency application treatment.

The gas-liquid separation member 905 may also be mounted to the opening 932A by using the method described in the embodiment 3. In that case, during the heating process for evaporating solvent after the repellency application agent has been applied, the gas-liquid separation member 905 needs to be joined to the opening 932A. At this time, the seal member 932 may be melted and joined to the gas-liquid separation member 905, or a bonding layer of thermosetting adhesive or hot melt adhesive may be interposed between them for bonding.

The ink tank 901 has a blade 936 that can wipe an underside of the seal member 932 including the gas-liquid separation member 905. Denoted 935 is a stopper member for defining the upper position of the arm member 931.

Designated 924 and 925 are first and second cap members installed vertically movable on the apparatus body. The second cap member 925 is connected through a suction pump 926 to a waste liquid tank not shown. Denoted 927 is a platen for guiding a print medium to a predetermined print position for printing by the print head 902. The print medium is fed by a feeding mechanism not shown in a subscan direction that crosses the main scan direction (arrows A1, A2). By repetitively alternating the main scan of the print head 902 while ejecting ink and the feeding of the print medium in the subscan direction, an image is formed progressively on the print medium.

Figure 16:
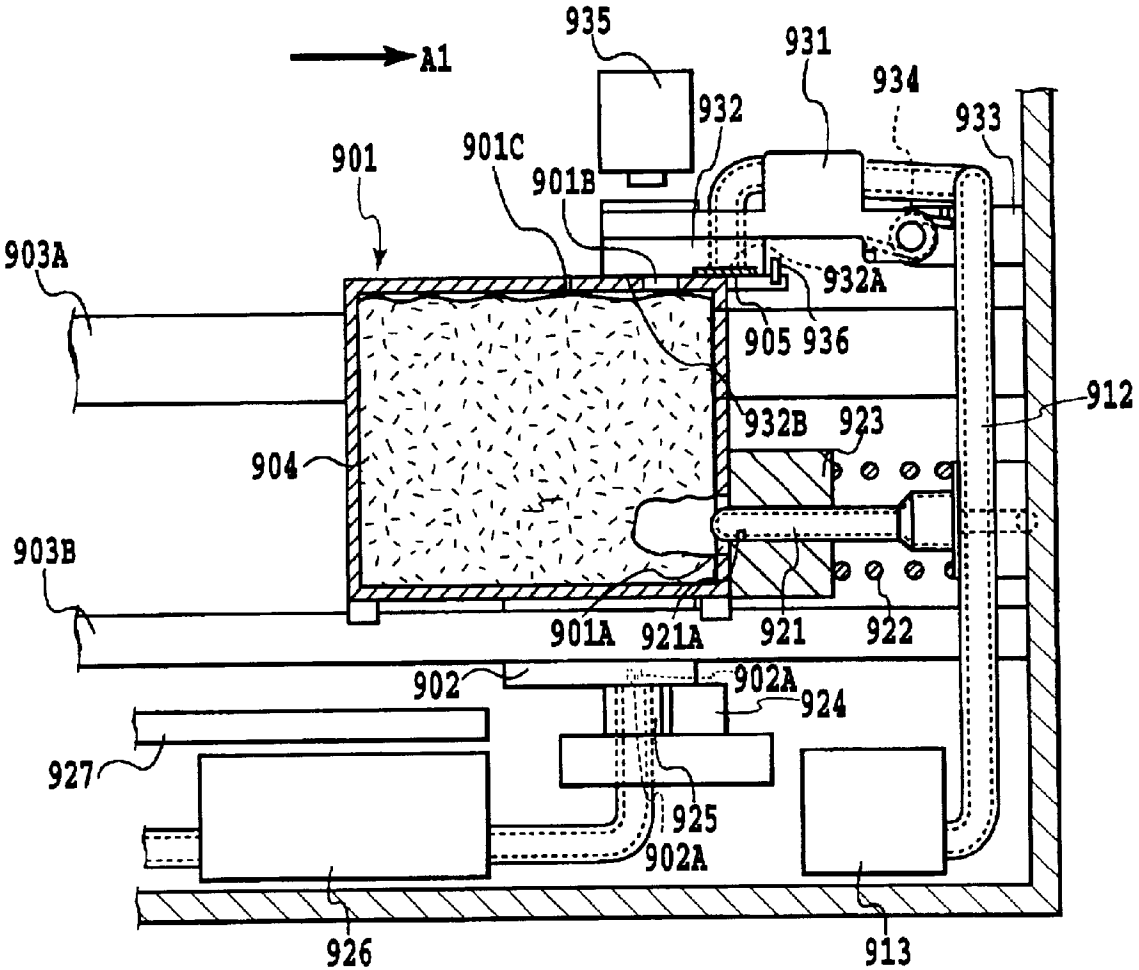
FIG. 16 is a cross-sectional view of the ink jet printing apparatus in a power-off state or standby state.

During the printing operation, the print head 902 moves in the direction of arrow A1, A2 over an area to the left of the home position shown in FIG. 16 while at the same time ejecting ink, thus forming an image on the print medium.

When the print head 902 reaches the home position, the first and second cap members 924, 925 are moved up, as shown in FIG. 16, and the second cap member 925 caps the nozzle portion 902A of the print head 902. At this time, the seal member 923 still closing the through-hole 921A in the hollow protruding member 921 closes the ink intake port 901A, and the seal member 932 closes the suction port 901B. With the ink intake port 901A and the suction port 901B closed in this manner, the ink contained in the ink tank 901 is prevented from increasing its viscosity. The gas-liquid separation member 905 is situated to the right of, and apart from, the suction port 901B in FIG. 16 to prevent its contact with ink contained in the ink tank 901. Avoiding long-term contact between the gas-liquid separation member 905 and ink in this way can protect the gas-liquid separation member 905 against performance degradation. At the home position the print head 902 undergoes a recovery operation involving discharging ink not contributing to the image formation, to keep the ink ejection performance of the print head 902 in good condition. The recovery operation includes an operation which introduces a negative pressure developed by the suction pump 926 into the second cap member 925 to forcibly suck out ink from the openings of the nozzle portion 902A, and an operation which causes the nozzle portion 902A to eject ink into the second cap member 925.

Figure 17:
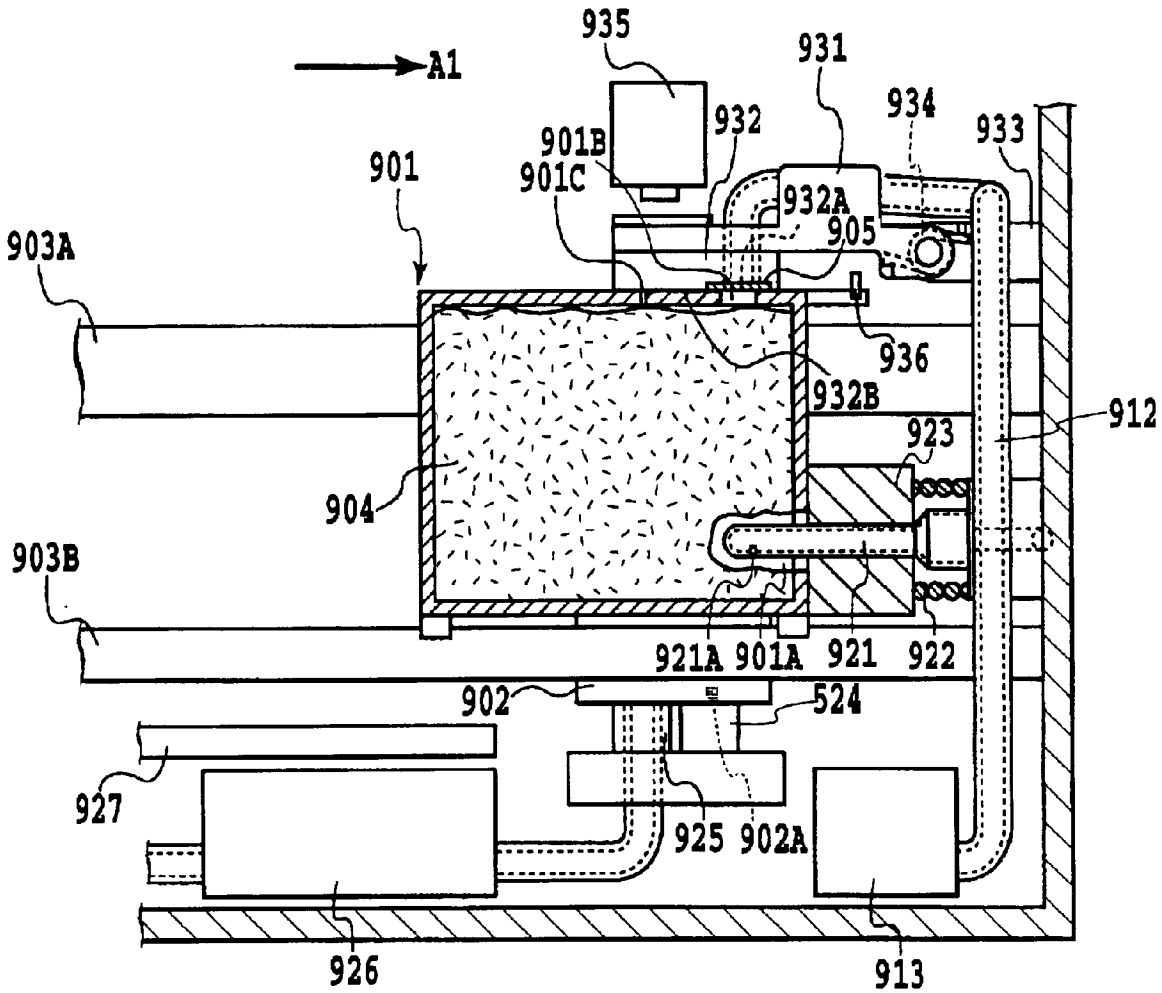
FIG. 17 is a cross-sectional view of the ink jet printing apparatus in an ink supply state.

During the ink supply operation, as shown in FIG. 17, the print head 902 moves from the home position further in the arrow A1 direction to the ink supply position. When the print head 902 arrives at the ink supply position, the first and second cap members 924, 925 are raised and the first cap member 924 caps the nozzle portion 902A of the print head 902, hermetically closing it. At this time, the seal member 923 still closing the ink intake port 901A moves relative to the hollow protruding member 921 to open the through-hole 921A. Because the through-hole 921A is opened in the ink tank 901, an ink supply system is formed connecting the ink tank 901 and the supply tank. The seal member 932 closes the atmosphere communication port 901C and connects the opening 932A to the suction port 901B to form an air suction system between the suction port 901B and the suction pump 913. The gas-liquid separation member 905 is provided in the suction system.

In supplying ink, the suction pump 913 draws air from the ink tank 901 through the gas-liquid separation member 905 and exhausts it out into a waste liquid container not shown. As a result the pressure in the ink tank 901 becomes negative, drawing the ink from the supply tank into the ink tank 901 by suction. The ink that flowed into the ink tank 901 becomes soaked in the ink absorber 904, raising the ink level in the tank. The speed at which the ink level rises depends on a suction force of the suction pump 913, and is set at an appropriate speed by controlling the operation of the pump. When the ink level reaches the gas-liquid separation member 905, the ink supply operation is automatically stopped because the gas-liquid separation member 905 does not pass liquids such as ink. The individual subtanks 901*c*, 901*m*, 901*y*, 901*b* begin to be supplied with ink simultaneously. The supply of ink is automatically stopped individually for each subtank by the associated gas-liquid separation member 905 when the subtank is filled with ink.

After the ink supply operation is completed, the print head 902 is moved to the home position or print operation position, restoring the printing apparatus to the state shown in FIG. 16 or FIG. 14.

As the ink tank 901 is moved, the blade 936 comes into contact with the underside of the seal member 932 and wipes its underside including the gas-liquid separation member 905 while pivoting the arm member 931 up and down. This wiping operation removes viscous ink and other foreign matters adhering to the gas-liquid separation member 905, the opening 932A and the seal portion 932B and thereby keeps them in good condition.

The present invention is not limited to the configuration of the above embodiment. For example, in an ink tank which comprises a container body containing ink to be supplied to the print head, an opening for supplying ink, and an atmosphere communication port for communicating the interior of the container body to the atmosphere, a gas-liquid separation member may be mounted in a way disclosed in this invention at a location where the ink tank communicates with the atmosphere.

An arrangement in which the ink tank is connected to the supply tank through a tube will be explained.

Figure 18:
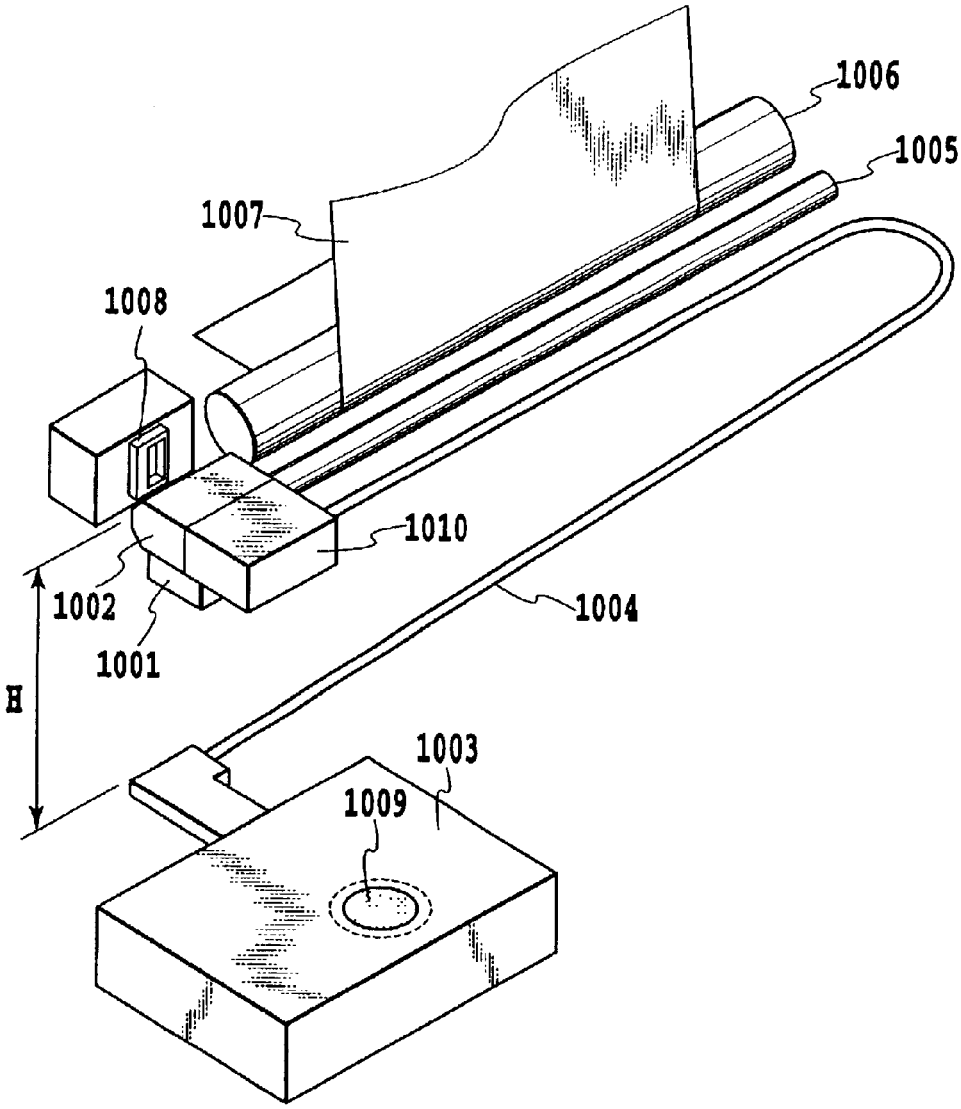
FIG. 18 is a schematic diagram showing an ink jet printer applying the present invention.

There is a method in which a print head 1002 and an ink tank 1010 are mounted on a carriage 1001 and ink is supplied from a supply tank 1003 through a tube 1004 to the ink tank 1010, as shown in FIG. 18. To develop a negative pressure, the supply tank 1003 is arranged at a level a few centimeters H lower than a gravity height (or pressure head) of the print head 1002. Denoted 1007 is a print medium, and 1008 a cap for preventing nozzles of the print head 1002 from drying when power is turned off or in a standby state.

Designated 1009 is a gas-permeable member secured to the supply tank which allows air from outside to enter as the ink volume in the supply tank decreases and which also prevents a possible ink leakage to the outside.

In a method which does not use a supply tank but uses a replaceable ink tank on the carriage (on-carriage system), too, the gas-permeable member can be employed. The gas-permeable member (not shown) may be fixed at a desired position on the ink tank.

In addition to the ink jet printing apparatus, the construction disclosed in this invention for mounting the gas-liquid separation members can also be applied to electric and electronic devices. For example, it may be applied to communication portions connecting an interior of devices to their exterior and moving parts, such as switches and buttons, where there is a possibility of water entering the interior of devices and thus the use of the gas-liquid separation member is preferred for prevention of failure due to ingress of water.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laid-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

As described above, with this invention, only after the porous members are mounted to the porous member holding portions, is the repellency application processing performed on the porous members, so that the porous members are not subjected to heat after the repellency application processing. The porous members are therefore protected against deterioration of their property and can maintain high repellency and perform a reliable gas-liquid separation.

The ink tank manufactured according to the liquid tank manufacturing method of this invention can maintain a high repellency performance at all times and thus prevent an ink leakage.

In the ink jet printing apparatus using such an ink tank, the ink tank can be supplied a sufficient amount of new ink by sucking the gas-liquid separation portion to produce a negative pressure in the ink tank. Further, because the ink tank has a sufficient repellency, it is possible to prevent an ink overflow if the suction operation is continued after the ink tank is filled with ink.

Further, forming the porous members from PTFE can provide a still higher repellency.

Further, according to the structural body manufacturing method of this invention, since, after having been applied with a repellency application agent, the gas-liquid separation members are heated and at least outer peripheries of the gas-liquid separation members are integrally joined to the communication portions, the heat applied to the gas-liquid separation members can be limited to only those locations where the outer peripheries of the gas-liquid separation members are joined to the communication portions, thus minimizing deteriorations of the thermally fragile gas-liquid separation members.

If, prior to heating the gas-liquid separation members, a layer of adhesive, e.g. a thermosetting adhesive that is hardened by the heating of the gas-liquid separation members and a hot melt adhesive that melts upon heating of the gas-liquid separation members, is formed between at least the outer peripheries of the gas-liquid separation members and the communication portions, it is possible to integrally join the outer peripheries of the gas-liquid separation members to the communication portions with the adhesive at a heating temperature that will not adversely affect the gas-liquid separation members. This can prevent a thermal deterioration of the gas-liquid separation members. Furthermore, no special joining device is required, which ensures easy and swift joining of the gas-liquid separation members to the communication portions.

In a liquid tank in which a structural body has a negative pressure introducing portion for introducing a negative pressure into the tank and a liquid intake portion for drawing a liquid into the tank by the negative pressure introduced by the negative pressure introduction portion, it is possible with this invention to prevent a trouble that the liquid drawn into the liquid tank by the negative pressure may get sucked out from the negative pressure introducing portion.

In a liquid tank in which a structural body has a casing for accommodating a liquid, an opening for drawing out the liquid from the casing, and an atmosphere communication portion for communicating the interior of the casing to the atmosphere, it is possible with this invention to prevent the liquid in the casing from leaking out from the atmosphere communication portion.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A method of manufacturing a structural body, wherein the structural body has a communication portion for communicating an interior of the structural body to an exterior thereof and a gas-liquid separation member permeable only to gases and arranged on the communication portion, the method comprising the steps of:

mounting the gas-liquid separation member to the communication portion; and after the mounting step, applying repellency to the gas-liquid separation member with a repellency application agent.

2. A method of manufacturing a structural body according to claim 1, wherein the gas-liquid separation member is a porous member having openings necessary to pass gases.

3. A method of manufacturing a structural body according to claim 1, wherein the gas-liquid separation member is made from PTFE (polytetrafluoroethylene).

4. A method of manufacturing a liquid tank, wherein the liquid tank has a negative pressure introducing portion for introducing a negative pressure into the liquid tank, a liquid intake portion for drawing a liquid into the liquid tank by the negative pressure introduced by the negative pressure introducing portion, and a gas-liquid separation member permeable only to gases and arranged on the negative pressure introducing portion, the method comprising the steps of:

mounting the gas-liquid separation member to the negative pressure introducing portion; and after the mounting step, applying repellency to the gas-liquid separation member with a repellency application agent.

5. A method of manufacturing a liquid tank, wherein the liquid tank has a container body for accommodating a liquid, an opening for drawing out the liquid, an atmosphere communication port for communicating the container body to the atmosphere, and a gas-liquid separation member permeable only to gases and arranged on the atmosphere communication port, the method comprising the steps of:

mounting the gas-liquid separation member to the atmosphere communication port; and after the mounting step, applying repellency to the gas-liquid separation member with a repellency application agent.

6. A method of manufacturing a liquid tank according to claim 4, wherein the gas-liquid separation member is a porous member having openings necessary to pass gasses.

7. A method of manufacturing a liquid tank according to claim 4, wherein the gas-liquid separation member is made from PTFE (polytetrafluoroethylene).

8. A method of manufacturing an ink jet printing apparatus, wherein the ink jet printing apparatus has a liquid tank, the liquid tank having a negative pressure introducing portion for introducing a negative pressure into the liquid tank and a liquid intake portion for drawing a liquid into the liquid tank by the negative pressure introduced by the negative pressure introducing portion;

a negative pressure generation mechanism for applying a negative pressure to the liquid tank to introduce the liquid into the liquid tank; and a gas-liquid separation member permeable only to gases and arranged in a vicinity of a joint portion of the negative pressure generation mechanism with the negative pressure introducing portion;

the method comprising the steps of:

mounting the gas-liquid separation member to a member in a vicinity of the joint portion that forms other than the liquid tank; and after the mounting step, applying repellency to the gas-liquid separation member with a repellency application agent.

9. A method of manufacturing an ink jet printing apparatus according to claim 8, wherein the gas-liquid separation member is a porous member having openings necessary to pass gasses.

10. A method of manufacturing an ink jet printing apparatus according to claim 8, wherein the gas-liquid separation member is made from PTFE (polytetrafluoroethylene).

11. A method of manufacturing a structural body, wherein the structural body has a communication portion for communicating an interior of the structural body, into which a liquid is introduced, to an exterior thereof through a gas-liquid separation member permeable only to gases, the method comprising the steps of:

coating the gas-liquid separation member with a repellency application agent; and after the coating step, joining at least an outer peripheral portion of the gas-liquid separation member to the communication portion during a heating operation of heating the gas-liquid separation member so as to fix the repellency application agent thereto.

12. A method of manufacturing a structural body according to claim 11, further comprising the step of:

before the heating step, forming an adhesive layer between at least an outer peripheral portion of the gas-liquid separation member and the communication portion to bond them together.

13. A method of manufacturing a structural body according to claim 12, wherein the adhesive making up the adhesive layer is a thermosetting adhesive that is hardened by heating the gas-liquid separation member.

14. A method of manufacturing a structural body according to claim 12, wherein the adhesive making up the adhesive layer is a hot melt adhesive that is melted by heating the gas-liquid separation member.

15. A method of manufacturing a structural body according to claim 11, wherein the gas-liquid separation member is a porous member having openings necessary to pass gasses.

16. A method of manufacturing a structural body according to claim 11, wherein the gas-liquid separation member is made from PTFE (polytetrafluoroethylene).

17. A method of manufacturing a structural body according to claim 11, wherein the structural body is a liquid tank having a negative pressure introducing portion for introducing a negative pressure into the structural body and a liquid intake portion for drawing a liquid into the structural body by the negative pressure introduced by the negative pressure introducing portion, and the communication portion is the negative pressure introducing portion.

18. A method of manufacturing a structural body according to claim 11, wherein the structural body is a liquid tank having a casing for accommodating a liquid, an opening for drawing out the liquid from the casing, and an atmosphere communication portion for communicating an interior of the casing to the atmosphere.

19. A liquid tank for accommodating a liquid, manufactured by the method claimed in claim 18.

20. A liquid tank according to claim 19, wherein the liquid is an ink or a processing liquid for adjusting a performance of printing the ink on a print medium.

21. A method of manufacturing an ink jet printing apparatus, wherein the ink jet printing apparatus has a liquid tank, the liquid tank having a negative pressure introducing portion for introducing a negative pressure into the liquid tank and a liquid intake portion for drawing a liquid into the liquid tank by the negative pressure introduced by the negative pressure introducing portion;

a negative pressure generation mechanism for applying a negative pressure to the liquid tank to introduce the liquid into the liquid tank; and a gas-liquid separation member permeable only to gases and arranged in a vicinity of a joint portion of the negative pressure generation mechanism with the negative pressure introducing portion;

the method comprising the steps of:

coating the gas-liquid separation member with a repellency application agent; and after the coating step, joining at least an outer peripheral portion of the gas-liquid separation member to a member in a vicinity of the joint portion that forms other than the liquid tank during a heating operation of heating the gas-liquid separation member so as to fix the repellency application agent thereto.

22. A method of manufacturing an ink jet printing apparatus according to claim 21, further comprising the step of:

before the heating step, forming an adhesive layer between at least an outer peripheral portion of the gas-liquid separation member and the communication portion to bond them together.

* * * * *